US007717832B2

(12) United States Patent
Webber et al.

(10) Patent No.: US 7,717,832 B2
(45) Date of Patent: *May 18, 2010

(54) SHOULDER PRESS EXERCISE MACHINE

(75) Inventors: Randall T. Webber, La Jolla, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 17 days.

This patent is subject to a terminal disclaimer.

(21) Appl. No.: 11/960,447

(22) Filed: Dec. 19, 2007

(65) Prior Publication Data

US 2008/0132389 A1 Jun. 5, 2008

Related U.S. Application Data

(63) Continuation of application No. 10/699,992, filed on Nov. 3, 2003, now Pat. No. 7,331,911.

(51) Int. Cl.
*A63B 21/062* (2006.01)
*A63B 21/08* (2006.01)
*A63B 23/02* (2006.01)

(52) U.S. Cl. ..... 482/100; 482/97; 482/135; 482/137; 482/142

(58) Field of Classification Search ..... 482/51, 482/72, 92–101, 135–138, 142, 907
See application file for complete search history.

(56) References Cited

U.S. PATENT DOCUMENTS

| | | | |
|---|---|---|---|
| 2,145,940 | A | 2/1939 | Marlowe |
| 4,441,708 | A | 4/1984 | Brentham |
| 4,641,833 | A | 2/1987 | Trethewey |
| 4,743,010 | A | 5/1988 | Geraci |
| 4,822,038 | A | 4/1989 | Maag |
| 4,844,456 | A | 7/1989 | Habing et al. |
| 4,949,958 | A | 8/1990 | Richey |
| 5,254,067 | A | 10/1993 | Habing et al. |
| 5,330,404 | A | 7/1994 | Lopeteguy et al. |
| 5,330,405 | A | 7/1994 | Habing et al. |

(Continued)

FOREIGN PATENT DOCUMENTS

| | | | |
|---|---|---|---|
| CA | 2075331 | A * | 2/1994 |

*Primary Examiner*—Loan H Thanh
*Assistant Examiner*—Victor K Hwang
(74) *Attorney, Agent, or Firm*—Procopio, Cory, Hargreaves & Savitch LLP

(57) ABSTRACT

A shoulder press exercise machine has a main frame, a user support frame movably mounted on the frame for supporting a user in an exercise ready position, at least one exercise arm movably mounted on one of the frames and movable between a start position in which handles are located in front of the shoulders of a user on the user support frame and an end position in which the handles are located above the head of the user. A connecting linkage connects movement of the exercise arm to movement of the user support frame, so that movement of the exercise arm from the start to the end position simultaneously moves the user support frame. A load resists movement of at least one of the moving parts of the machine. The combined motion of the user, user support frame and exercise arm between the start and end position substantially replicates the natural movement of the upper part of a human body when performing a free weight shoulder press exercise.

26 Claims, 22 Drawing Sheets

U.S. PATENT DOCUMENTS 5,342,270 A 8/1994 Jones
5,352,171 A * 10/1994 Lin ..... 482/96
5,354,248 A 10/1994 Rawls et al.
5,356,358 A 10/1994 Chen
D357,041 S 4/1995 McBride et al.
5,417,634 A 5/1995 Habing
5,478,298 A 12/1995 Chen
5,520,599 A 5/1996 Chen
5,527,243 A 6/1996 Chen
5,527,250 A 6/1996 Chen
5,533,953 A 7/1996 Lui et al.
D372,509 S 8/1996 Yang
5,547,444 A 8/1996 Huang et al.
5,573,482 A 11/1996 Wang et al.
5,580,340 A 12/1996 Yu
5,582,563 A 12/1996 Fan
5,616,105 A 4/1997 Wang et al.
5,626,542 A 5/1997 Dalebout et al.
5,643,147 A * 7/1997 Huang ..... 482/72
5,669,865 A 9/1997 Gordon
5,674,161 A * 10/1997 Lin ..... 482/96
5,676,626 A 10/1997 Huang
5,683,334 A 11/1997 Webber
5,690,593 A 11/1997 Huang
5,720,695 A 2/1998 Eckmann
5,722,918 A * 3/1998 Lee ..... 482/72
5,810,698 A 9/1998 Hullett et al.
5,897,467 A 4/1999 Habing et al.
5,899,836 A 5/1999 Chen
5,938,570 A 8/1999 Maresh
5,944,641 A 8/1999 Habing
5,961,427 A 10/1999 Habing et al.
5,971,901 A 10/1999 Shaw
6,004,247 A 12/1999 Webber
6,120,419 A * 9/2000 Huang ..... 482/96
6,135,930 A 10/2000 Kuo
6,142,914 A 11/2000 Crawford et al.
6,162,153 A 12/2000 Perez et al.
6,264,588 B1 * 7/2001 Ellis ..... 482/137
6,312,366 B1 11/2001 Prusick
6,605,024 B2 * 8/2003 Stearns ..... 482/142
6,752,748 B1 6/2004 Scotti
6,811,522 B1 11/2004 McQuinn
6,855,098 B2 2/2005 Reitz et al.
6,913,565 B2 7/2005 Mitchell et al.
6,916,278 B2 7/2005 Webber
6,971,978 B2 * 12/2005 Hyder ..... 482/142
7,052,444 B2 5/2006 Webber
7,052,446 B2 5/2006 Morris et al.
7,070,545 B2 7/2006 Lull et al.
7,108,641 B2 9/2006 Pertegaz-Esteban
7,141,003 B2 11/2006 Wu
7,141,008 B2 11/2006 Krull et al.
7,220,221 B2 5/2007 Mosimann et al.
7,223,213 B2 5/2007 Golesh
7,229,389 B2 6/2007 Hong
7,322,906 B2 1/2008 Webber
7,331,911 B2 * 2/2008 Webber et al. ..... 482/137
7,335,140 B2 2/2008 Webber et al.
7,357,768 B2 4/2008 Marshall
7,361,125 B2 4/2008 Webber et al.
7,384,381 B2 6/2008 Webber et al.
7,468,024 B2 12/2008 Webber et al.
2002/0013199 A1 1/2002 Giannelli et al.
2002/0187879 A1 12/2002 Ball et al.
2003/0199362 A1 10/2003 Chamberlin
2004/0005966 A1 1/2004 Chen
2005/0032611 A1 * 2/2005 Webber et al. ..... 482/72
2006/0247107 A1 11/2006 Carter
2006/0276313 A1 12/2006 Hong
2007/0232462 A1 10/2007 Webber et al.
2007/0293377 A1 12/2007 Webber et al.
2007/0293378 A1 12/2007 Webber et al.
2008/0058176 A1 3/2008 Webber et al.
2008/0153677 A1 6/2008 Webber et al.
2008/0182732 A1 7/2008 Webber et al.
2008/0214365 A1 9/2008 Webber et al.
2008/0214367 A1 9/2008 Webber et al.
2008/0220950 A1 9/2008 Webber et al.
2008/0234110 A1 9/2008 Webber et al.
2008/0242517 A1 * 10/2008 Webber et al. ..... 482/52
2008/0248929 A1 10/2008 Webber et al.

* cited by examiner

SHOULDER PRESS EXERCISE MACHINE

RELATED APPLICATION

The present application is a Continuation of co-pending U.S. patent application Ser. No. 10/699,992 filed on Nov. 3, 2003, the entire disclosure of which is incorporated herein by reference.

BACKGROUND

1. Field of the Invention

This invention relates generally to exercise machines, and is particularly concerned with an exercise machine for performing shoulder press exercises which has a moving user support.

2. Related Art

Free weight shoulder press exercises using barbells or dumbbells involve an exerciser in a standing position holding dumbbells at a position just above their shoulders, and then raising the weights over their head. The free standing shoulder press movement is one of the most fundamental exercises and is one of the standard measures of strength. However, it can be difficult for many people to perform. It requires balance and coordination as well as strength for someone to raise a weight or weights over their head with a slight arcing motion while maintaining balance. This is a compound or multi-joint movement which involves the front and outer deltoid muscles of the shoulder. Improper form during the exercise (jerking or swinging the weights upward, leaning forward or arcing backward) can throw the exerciser off balance, which makes the exercise more difficult, increases stress to the joints, and can lead to possible injury.

In order to help the less conditioned exerciser perform this basic exercise, the seated shoulder press bench was developed. This provided stabilizing support by placing the user in a seated position with back support, preventing the user from swinging the weights, walking with the weights, or arching their back while performing the exercise. A further safety development replaced the free weight movement with a machine utilizing an exercise arm pivotally attached to the stationary bench or user seat. Such machines typically have an exercise arm movably mounted on a stationary frame with a seat and back pad or user support rigidly mounted on a stationary frame, with plate loading, selectorized weight stack, hydraulic, pneumatic or elastic bands for resistance.

Some known shoulder press exercise machines are described in U.S. Pat. No. 5,554,089 of Jones, U.S. Pat. No. 5,810,701 of Ellis, and U.S. Pat. No. 5,562,577 of Jones. Each of these machines has a main frame, a user support rigidly mounted to the main frame, and a plate-loaded exercise arm pivotally mounted on the main frame. All three of these machines have exercise arms that provide a converging exercise motion, because the user engaging handles are forced inwards as the exercise arm is urged upward in performing a shoulder press exercise. Each of the machines has weight receiving pegs on the outboard side of the exercise arm, increasing the overall size of the machine and creating a safety hazard as the weight swings during exercise machine use. Jones and Ellis provide an exaggerated arc in the exercise motion, preventing the user engaging handles from ending up in line with the side centerline of the user's body at the end of the exercise, as is the case with the free weight shoulder press.

U.S. Pat. No. 4,844,456 of Habing describes a machine providing multiple exercises, including a forward inclined shoulder press. Again, the user support is fixed in position, and an exaggerated arc is provided by the pivoting exercise arm. Back supported shoulder press exercise capability is also provided in the machines described in U.S. Pat. Nos. 5,447,480 and 5,549,530 of Fulks, but again the pivoted exercise arm provides an exaggerated arc and prevents the user engaging handles from ending up in the optimum finish position for a shoulder press exercise. U.S. Pat. No. 6,080,091 of Habing describes an exercise machine with a pressing arm assembly comprising a main arm pivotally mounted on the main frame and two handle arms pivotally coupled to the main arm cross beam. The handle arms can pivot freely inwardly and outwardly. The exercise resistance, in this case a weight stack, is associated with the main arm. This design provides a straight pressing motion as well as an inward converging press motion and an outward to inward "fly" motion. Again, the user seat or support is fixed in position on the frame.

Some known multi-purpose exercise machines for performing various different types of exercise have movable seats or user supports. In U.S. Pat. No. 5,330,405 of Habing, the machine has a stationary base frame, a lever arm pivotally mounted on the frame, and a sub frame pivotally connected to the base frame and supported by the lever arm. The sub frame comprises a user support and an exercise arm linked to the lever arm by cables and pulleys. The exercise arm for performing pressing exercises is pivotally connected to a portion of the sub frame at a location above the user. In order to perform a shoulder press, the user must sit on the user support leaning forward at an angle without benefit of back support, pressing the exercise arm forward and rotating it about its pivotal connection to the sub frame in order to pull the cables and cause the sub frame to lift.

U.S. Pat. No. 5,669,865 of Gordon describes a multi-purpose user support with a hinged, two-piece user support that folds and unfolds with each exercise repetition. The user support comprises a seat portion and a back portion which are pivotally connected together, and is pivotally connected to the main frame. A first exercise arm pivoted to the frame provides pressing and pull down exercises. The seat and back rest do not travel in a fixed relationship to each other, but fold and unfold during the exercise, working the abdominal and low back muscles even when other exercises are being performed. Due to the separate motion of the seat and back rest, additional supports such as a foot rest, safety belts, and thigh gripping surfaces are required to keep the user properly and safely positioned. In this machine, most of the combined weight of the user and user support remains on one side of the gravitational centerline of the user support, and this weight is used as a partial exercise resistance. Due to the working of the abdominal and low back muscles in every exercise movement, including press exercises, the exerciser cannot properly isolate any one specific muscle or muscle group. Because of this, the exerciser cannot fully fatigue other muscles, since the abdominals and lower back will always fatigue first.

None of the prior art exercise machines for performing shoulder press exercises properly simulate the slight arcing motion as well as the start and finish positions found in a free weight shoulder press exercise, while properly supporting the user's body throughout the exercise movement. Most or all shoulder press exercise machines with fixed user supports have an exaggerated and unnatural arcing movement during the exercise, and do not provide the proper starting and finishing alignment between the user and exercise arm handles.

SUMMARY

In one aspect, a shoulder press exercise machine is provided, which comprises a main frame having a user support mount, a user support frame movably mounted on the user support pivot mount for supporting a user in an exercise ready position and movable between a start position and an end position, an exercise arm movably mounted on one of the frames, the exercise arm having at least one user engagement device for gripping by a user in performing a shoulder press exercise and the exercise arm being movable between a start position in which the user engagement device is located in front of the shoulders of a user in a seated position on the user support frame and an end position higher than the start position in which the user engagement device is located above the head of the user, and a connecting linkage connecting movement of the exercise arm to movement of the user support frame, whereby movement of the exercise arm from the start to the end position simultaneously rotates the user support frame from the start to the end position, and a load for resisting movement of at least one of the moving parts of the machine, the combined motion of the user support frame and exercise arm between the start and end position substantially replicating the natural movement of the human body when performing a free weight shoulder press exercise.

In one embodiment, the user support mount is a pivot mount on the main frame which defines a vertical, gravitational center line of the pivotal movement. In some exemplary embodiments, the gravitational center line is positioned such that the combined weight of the user and user support frame is distributed on each side of the gravitational centerline of the pivot in both the start and end position and only a portion of the combined weight passes through the gravitational centerline during the exercise movement, so that a major portion of the weight of the user and user support does not remain on one side only of the gravitational centerline over the entire exercise movement. The user support frame has a first and second user support portions which support different locations on a user's body, and the user support portions are in fixed relation to one another and travel together in fixed relative positions between the start and end position of the user support frame. This keeps the user safely in the same, supported position throughout the exercise movement. The user support frame may be in a slightly reclined position at the start of the exercise, and moves from this position into a more reclined position at the end of the exercise movement.

The first user support portion may be a seat pad while the second user support portion may be an upper body support or a lower leg support. In other embodiments, both an upper body support and a lower leg support are provided on the user support frame. Alternatively, a stationary foot rest may be provided on the main frame. In one embodiment, the user support mount is positioned behind the hips of a user seated on the user support frame, and the exercise arm, which may be a single arm for dependent movement, or may be split into two separate arm portions for independent movement, is pivoted to the frame at a location behind the user, and extends forward on opposite sides of the user support frame to place the user engagement device or handle in a position for gripping by the user.

As the user pushes the exercise arm from the start position to the finish position, the exercise arm movement is linked to the user support frame by the connecting link. In one embodiment, where the user support mount is a pivot mount, movement of the exercise arm simultaneously and automatically rocks or rotates the user support frame from the start position to the end position. This rocking movement makes the exercise more fun to perform. The pivoting user support frame automatically aligns with the exercise arm to maintain proper positioning of the user throughout the exercise movement.

In one embodiment, the connecting link pivotally connects the user support frame to the exercise arm so that upward movement of the exercise arm about its pivotal connection to the main frame forces the user support frame to pivot rearward about its pivotal connection to the main frame. The connecting link has a first pivot connection to the user support frame and a second pivot connection to the exercise arm. The first pivot connection may be higher than the second pivot connection, so that the connecting link pulls the user support frame to force it to rotate. Alternatively, the first pivot connection may be lower, so that the connecting link pushes the user support frame to rotate into the end position.

In an alternative arrangement, the exercise arm may be slidably mounted for linear movement on the main frame, rather than pivotally connected to the main frame. In this alternative, as the exercise arm is pushed upward, the connecting link to the user support frame pulls the user support rearward.

The shoulder press exercise machine provides proper positioning of the user in both the start and end position, as well as a slight arcing motion of the upper body of the user which simulates the natural body movement found in a free weight exercise. Because movement of the exercise arm is linked to movement of the user support frame, the self-alignment of the user and user support throughout the exercise motion is automatic and continuous throughout the entire exercise range of motion. This combined movement maintains a beneficial alignment relationship between the user positioned on the user support frame and the user engaging device or handles on the exercise arm. The combined motion of the user support frame and exercise arm accurately replicates the natural, gradual rearward arcing arm movement of a traditional free weight barbell press exercise.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 2:
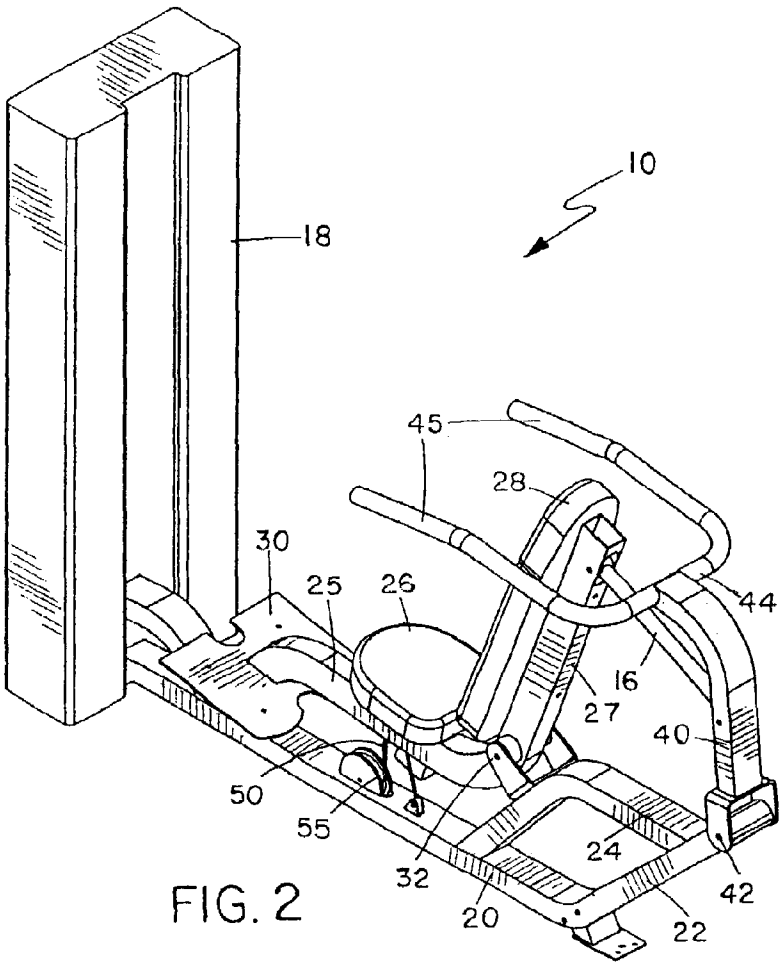
FIG. 2 is a rear perspective view of the machine of FIG. 1, also in the start position.

Certain embodiments as disclosed herein provide for a shoulder press exercise machine in which movement of an exercise arm is linked to movement of a user support frame.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 6 illustrate a shoulder press exercise machine 10 according to a first embodiment, which duplicates a free weight overhead press exercise without the disadvantages of a free weight exercise, i.e. balance, coordination, and strength to follow the proper movement path, and possible injury if the proper movement is not followed. Instead, the shoulder press machine 10 constrains the user to follow the proper exercise path, while fully supporting the user's body throughout the exercise for comfort and safety. The exercise carried out by this machine mimics the natural, slightly rearward arcing movement of a user's arms from the start to the finish position of an equivalent free weight shoulder press exercise.

The exercise machine 10 basically comprises a main frame 12, a user support frame 14 pivotally mounted on the main frame, an exercise arm 15 pivotally mounted on the main frame and linked to the user support frame by a connecting link 16, and an exercise resistance such as selectorized weight stack in housing 18 linked to the user support frame 14. The main frame 12 comprises a horizontal base section 20, a rearwardly inclined, rear upright section or strut 22, and a pivot mount section 24. The base section 20 is connected to the vertical weight stack housing 18 at its forward end. The weight stack housing 18 encloses a weight stack (not visible in the drawings) which runs on two guide rods (also not visible), as is standard in the field. The pivot mount section 24 comprises a brace strut or tube that is secured to both the base section and the rear upright section of the frame.

The user support frame 14 is designed to support a user in an exercise ready position. In this embodiment, the user support frame is generally L-shaped with a base 25 on which a seat pad 26 is adjustably mounted, and an upright 27 on which a back pad 28 is mounted for supporting a user's upper body. A foot plate or footrest 30 is secured to the forward end of the base 25. The frame 14 is pivotally mounted on the pivot mount section 24 of the frame via a pivot 32 located on the upright 27 close to the junction between the base and upright sections, so that the pivot is positioned directly under an exerciser 34 (see FIGS. 5 and 6) at a location close to the exerciser's hips. The seat pad 26 is mounted on a strut or post 35 which is telescopically engaged in tube 36 to allow the height of the seat pad relative to the frame to be adjusted for users of different heights. A stop 38 on the main frame adjacent the forward end of the user support frame acts to support the user support frame in the starting position of FIGS. 1,4 and 5.

Figure 1:
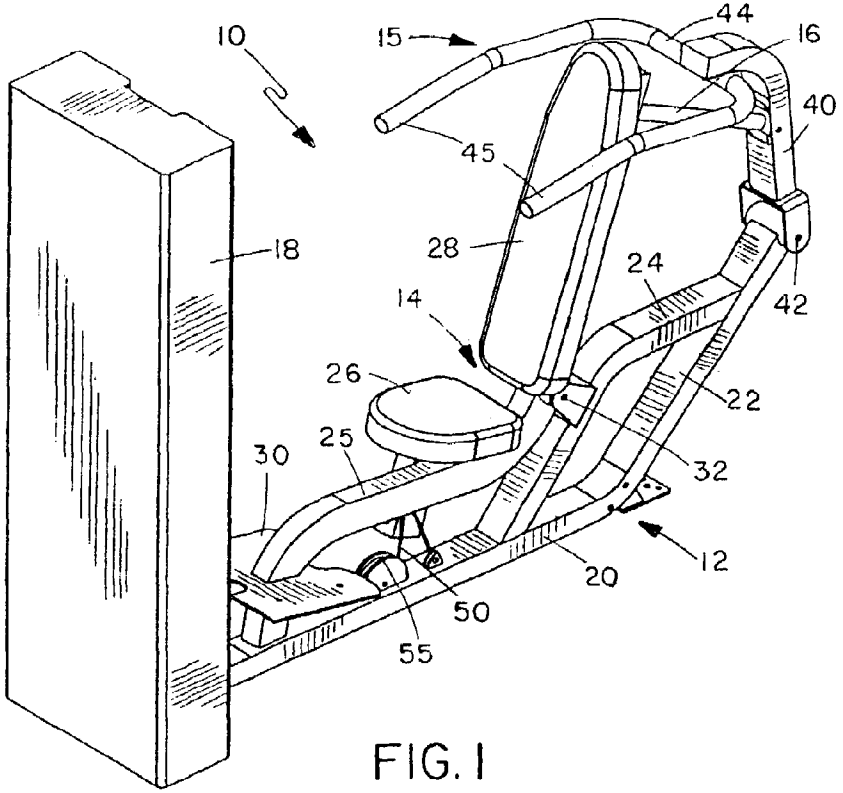
FIG. 1 is a front perspective view of a shoulder press exercise machine according to a first embodiment, with the user support and exercise arm in the start position adopted at the beginning of an exercise movement.
Figure 3:
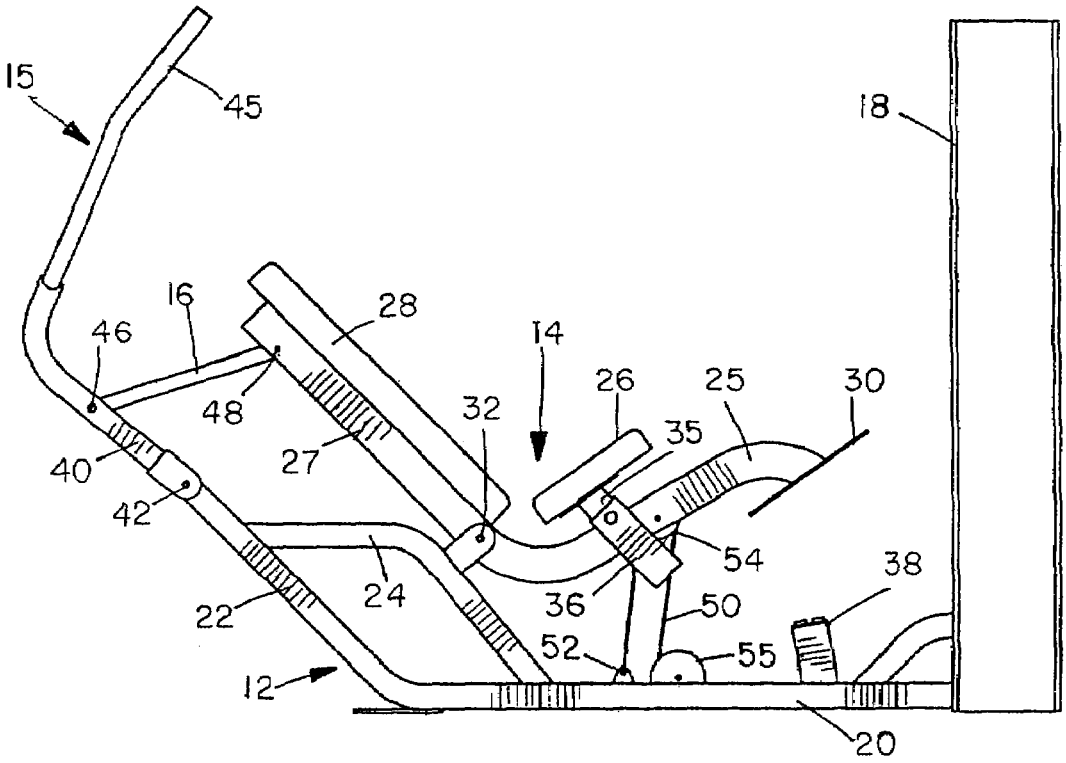
FIG. 3 is a side elevation view of the machine of FIGS. 1 and 2, with the user support and exercise arm in the end position adopted at the end of an exercise movement.
Figure 4:
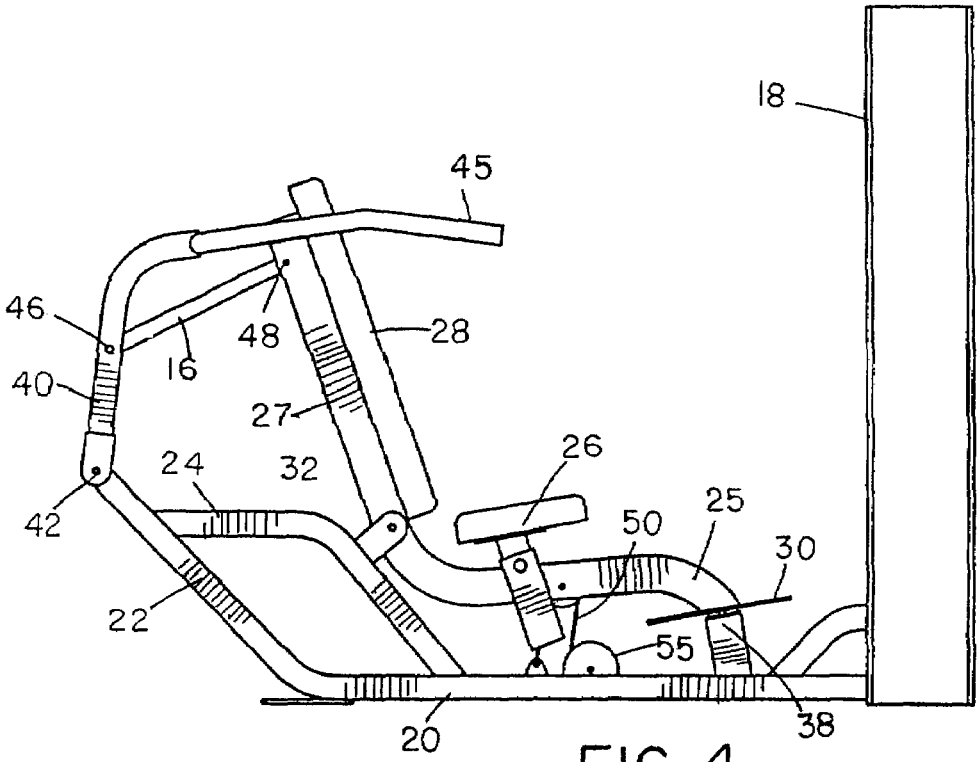
FIG. 4 is a side elevation view similar to FIG. 3, but illustrating the exercise start position as in FIGS. 1 and 2.

The exercise arm 15 is best illustrated in FIGS. 1 and 2, and has a first elongate member or strut 40 having one end pivoted to the top of upright frame strut 22 via pivot 42, and a U-shaped member having a central section 44 secured to the opposite end of strut 40 and opposite handle arms extending on opposite sides of the user seat, with user engaging handles 45 at the ends of the handle arms. The connecting link 16 comprises an arm having a first end pivoted to an intermediate point on the first member or strut of the exercise arm 15 via pivot 46 and a second end pivotally secured to the upper end of the rear upright 27 of the user support frame via pivot 48, as best illustrated in FIGS. 3 to 6.

A cable and pulley linkage, only part of which is visible in the drawings, links the base 25 of the user support frame to the weight stack. The cable and pulley linkage comprises a cable 50 extending from an anchor 52 on the base 20 of the main frame, around a pulley 54 on the underside of user support base 25, around a second pulley 55 on the main frame base 20, and from there through the base 20 and into the weight stack housing, where it extends around further pulleys before linking to a selectorized weight stack in a conventional manner.

Figure 5:
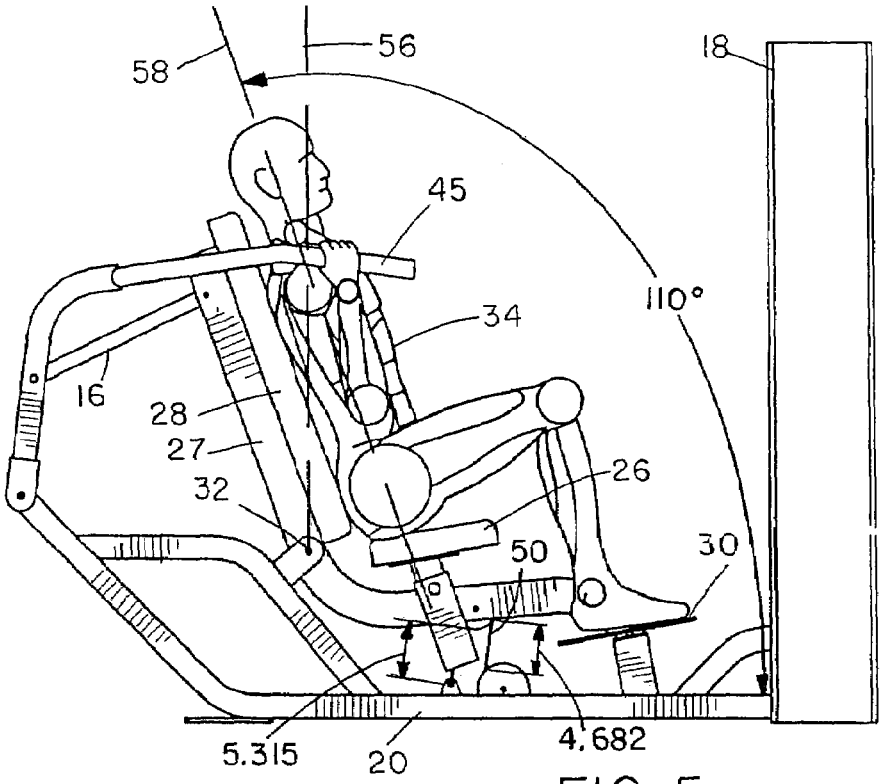
FIG. 5 is a side elevation view similar to FIG. 4, illustrating a user seated on the user support in the exercise start position.
Figure 6:
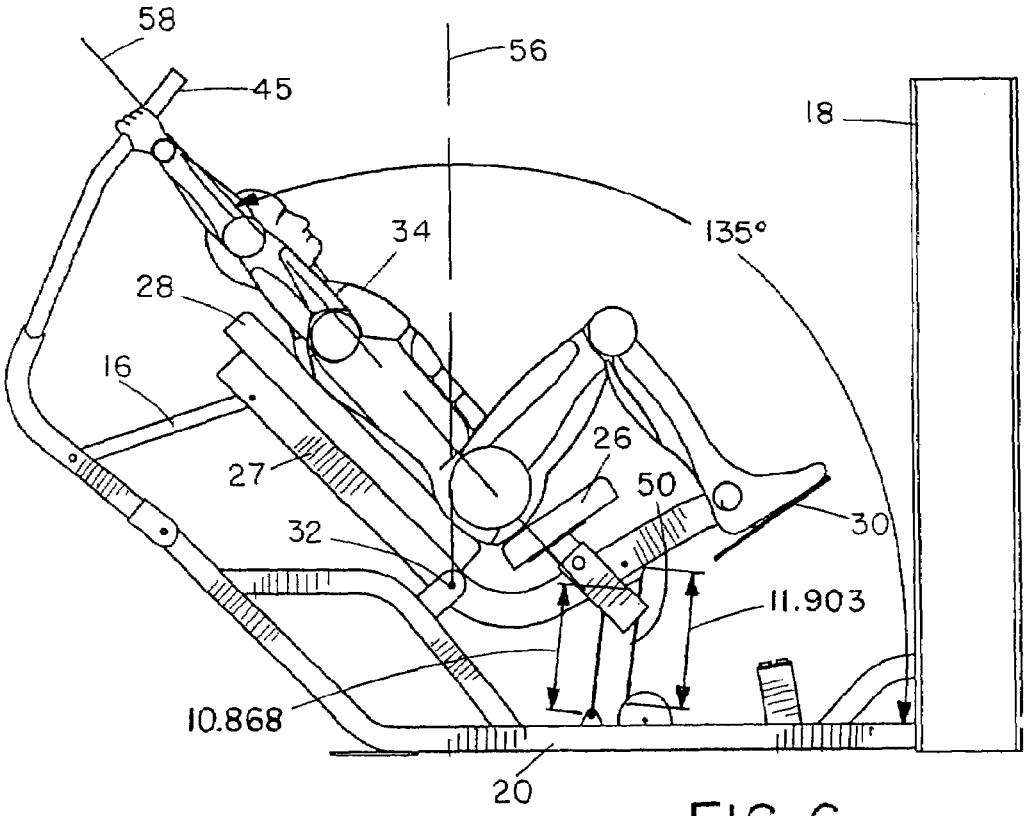
FIG. 6 is a side elevation view similar to FIG. 3, with a user seated on the user support, illustrating the user's position at the end of the shoulder press exercise.

FIGS. 5 and 6 illustrate a user 34 performing a shoulder press exercise on the machine 10, showing the angular orientation of the user support 14 in both the start and finish position, as well as the amount of cable pull, which determines the resistance felt by the user. To perform the exercise, the user sits on the seat in the start position of FIG. 5, where the seat is in a slightly rearwardly reclined position and the handle arms are in a lowered position with the hand grips below the user's chin and just in front of the user's shoulders. The user places their feet on the foot rest 30, and grabs the handles 45. In FIGS. 5 and 6, the dotted line 56 represents the gravitational centerline of the user support pivot 32, which is the gravitational centerline of the user performing the exercise. The dotted line 58 represents the side centerline of the exerciser. As can be seen in FIG. 5, the start position places the user in a slightly reclined position, with the rear upright 27 at an angle of around 110 degrees to the base of the main frame, with their hands at approximately shoulder level and forward of the side centerline of their body. In this position, the gravitational centerline 56 aligns with the center of the exerciser's shoulders and rearward of their hip, and approximately 75% of the combined user and user support weight is positioned forward of the gravitational centerline 56.

From the position of FIG. 5, the user pushes the handles upwards, rotating the exercise arm rearwardly about its pivot 42. At the same time, the exercise arm pulls the connecting link 16, which in turn causes the user support to rotate rearwards about pivot 32. This movement of the user support is resisted by the weights linked to cable 50. The user is placed in a back or upper body supported position with their hands slightly forward of the shoulders in the start position, as illustrated in FIG. 5, and then follows the slight natural arcing movement of a barbell press, finishing the exercise in a substantially reclined position of around 135 degrees to the horizontal or base of the frame, and around 45 degrees to the gravitational centerline, with their arms fully extended and in line with the side centerline 58 of their body, as illustrated in FIG. 6. The seat therefore reclines through an angle of around 25 degrees between the start and end positions. At the same time, the cable is pulled up by approximately 13 inches, based on subtracting the added total cable length in the start position (9.99 inches) from the added total cable length in the end position (22.77 inches).

The start and finish positions in this machine substantially mimic the start and finish position of a free weight shoulder press. The user is placed in a back supported, rearward lean at the start of the exercise, and finishes in a more rearward lean with their arms extending straight overhead. Because the user support rotates in the same direction as the exercise arm, the arcuate path of the exercise arm relative to the user support is reduced. This results in a more natural feeling exercise movement which more accurately replicates corresponding free weight exercise. The exercise movement provided with this machine accurately simulates the slight, natural arcing movement the arms go through when performing a barbell or dumbbell free weight shoulder press exercise. At the same time, the rocking movement of the user support while extending the arms makes the exercise more interesting and fun to perform. This may increase the user's motivation to repeat the exercise.

It can be seen that the position of the user support pivot beneath the user's body distributes the weight of the user's body and the support frame on both sides of the gravitational centerline in both the start and finish position of the exercise. The starting position in this case places the user support pivot rearward of the exerciser's hips, with the gravitational centerline 56 in line with the centerline of their shoulders. While the majority of the user's body starts forward of the gravitational centerline, the user rotates rearwards through this centerline during the exercise, and finish with the centerline bisecting the middle of their torso for a more evenly balanced distribution of weight at the end of the exercise.

In the starting position, approximately 75% of the total weight of the user and user support is on the forward side of the centerline 56. As the exercise arm is moved rearward, more of this weight passes through the gravitational centerline with a more even distribution of weight (approximately 50% on each side of the pivot) is achieved at the end of the exercise. This reduction is gradual and continuous and is not noticed by the user. The combined weight of the user and user support still has a reduced effect on the amount of starting resistance, since part of the user's weight is still placed rearward of the user support pivot, acting as a counterbalance to the exercise arm. By the same token, as the user passes rearward through the gravitational centerline, there is no appreciable drop off in resistance felt because of the balanced distribution of weight on each side of centerline 56.

This machine fully supports the exerciser throughout the exercise movement so that they do not have to worry about balance and coordination, unlike a free weight exercise. As seen in the drawings, the lower torso and upper leg region is supported on the seat, the upper torso is supported by the back rest while the lower leg region is supported by the foot rest. The exercise arm and user support are linked to one another to self-align throughout the exercise movement, so that the handles can be angled for a more comfortable start and finish position. Because the exercise arm travels in fixed rotation about its pivot, the path of the user engaging handles relative to the user support is predetermined, and is designed to reduce the risk of injury and limit stress to the muscles, tendons, ligaments, and joints.

Figure 7:
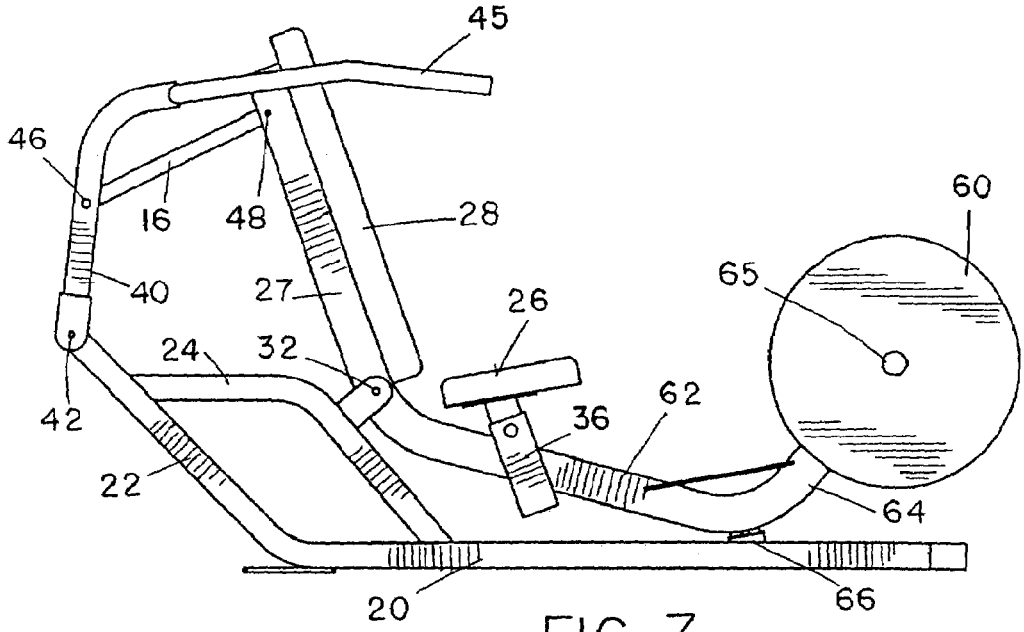
FIG. 7 is a side elevation view of a modified shoulder press exercise machine, illustrating the exercise start position.
Figure 8:
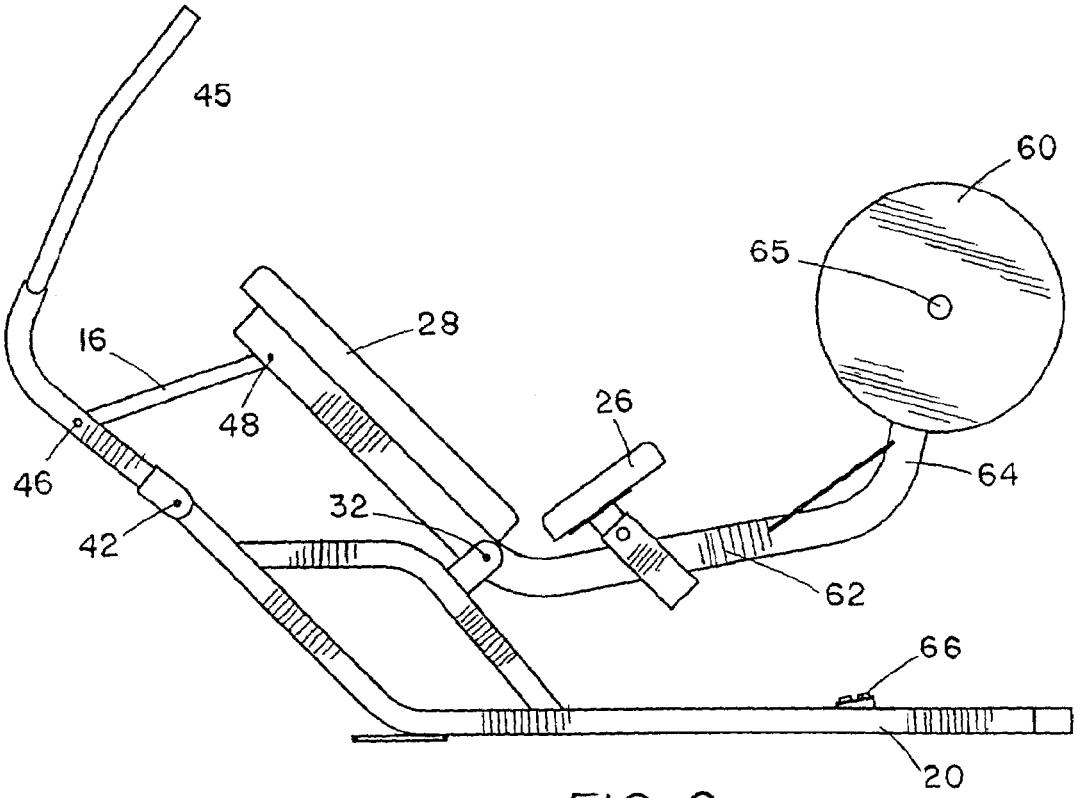
FIG. 8 is a side elevation view of the machine of FIG. 7, illustrating the exercise end position.

FIGS. 7 and 8 illustrate a machine similar to that of FIGS. 1 to 6, but replacing the weight stack with hand-loaded weight plates 60. Apart from the exercise resistance, the machine of FIGS. 7 and 8 is identical to the previous embodiment, and like references have been used for like parts as appropriate. In this embodiment, the base 62 of the user support is extended with an upwardly curved end portion 64. Weight receiving pegs 65 extend in opposite directions from the end of base end portion 64, for receiving a selected number of weight plates 60. The base 62 rests on stop pad 66 on the frame base portion 20 when the machine is in the start position of FIG. 7. Movement of the exercise arm from the start position of FIG. 7 into the raised, rearwardly rotated end position of FIG. 8 rotates the user support rearwardly about pivot 32, lifting the end portion 64 and weight plates 60 into the raised position.

The machine of FIGS. 7 and 8 operate in essentially the same way as that of the previous embodiment, with the user, user support frame, and exercise arm following essentially the same motions as illustrated in FIGS. 5 and 6. It has the same advantages of closely mimicking the movement of an exerciser when performing a free weight shoulder press exercise, while supporting the user's body safely and securely in the proper orientation. The user support starts and finishes in substantially the same orientations as in the previous embodiment, and the rocking movement may increase the user's interest in the exercise.

Figure 9:
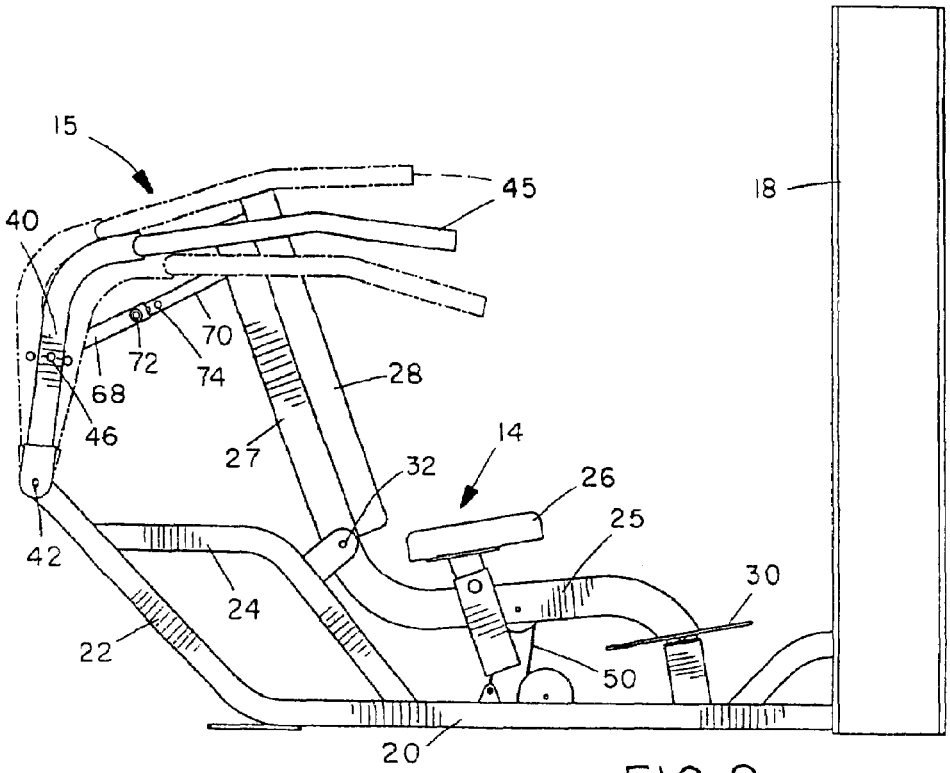
FIG. 9 is a side elevation view illustrating a modification of the machine of FIGS. 1 to 6 to provide adjustment of the starting height of the exercise arm.

In the embodiment of FIG. 9, the fixed length, single-piece connecting link 16 of FIGS. 1 to 6 is replaced with an adjustable, two-piece connecting link having a first, tube portion 68 pivoted to the rear strut or portion 40 of the exercise arm for rotation about pivot 48, and a second portion 70 telescopically engaged in the end of tube portion 68. The second portion is pivoted to the upper end of the rear upright 27 of the user support via pivot 48, in exactly the same way as link 16 of the previous embodiments. A releasable lock or snap pin 72 extends through an opening adjacent the end of tube portion 68 and into a selected opening 74 in the second portion 70 of the connecting link. Length of the connecting link can therefore be adjusted by releasing the lock pin 72 and moving the portion 70 into or out of the end of tube portion 68 until the desired length is reached, and then re-engaging the lock pin 72 in the aligned opening 74. Adjustment of the length of the connecting link allows the starting height of the exercise arm to be adjusted, as illustrated in dotted outline in FIG. 9, to adjust to the seated height of the user. All other parts of the machine in FIG. 9 are identical to parts in the first embodiment, and like reference numerals have been used as appropriate.

An adjustable length connecting link may replace a fixed length connecting link in either of the two embodiments described above, and also in any of the embodiments described below which have fixed length, rigid connecting links. The machine of FIG. 9 also operates in essentially the same way as that of the previous embodiments, with the user, user support frame, and exercise arm following essentially the same motions as illustrated in FIGS. 5 and 6, with the added advantage of allowing the user to adjust the handles to the optimum starting height.

Figure 10:
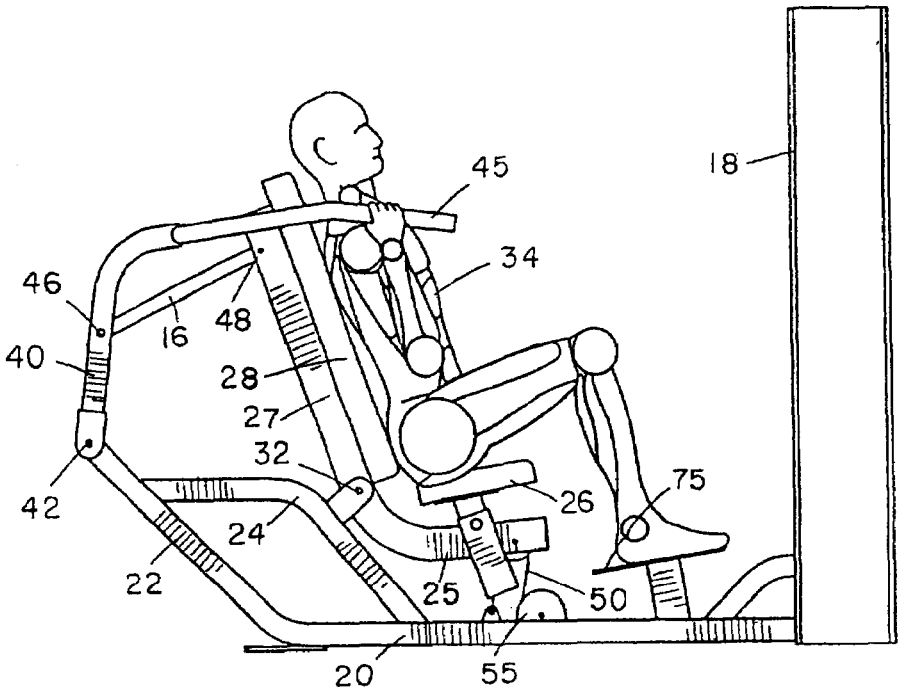
FIG. 10 is a side elevation view of a shoulder press exercise machine according to another embodiment illustrating the exercise start position.
Figure 11:
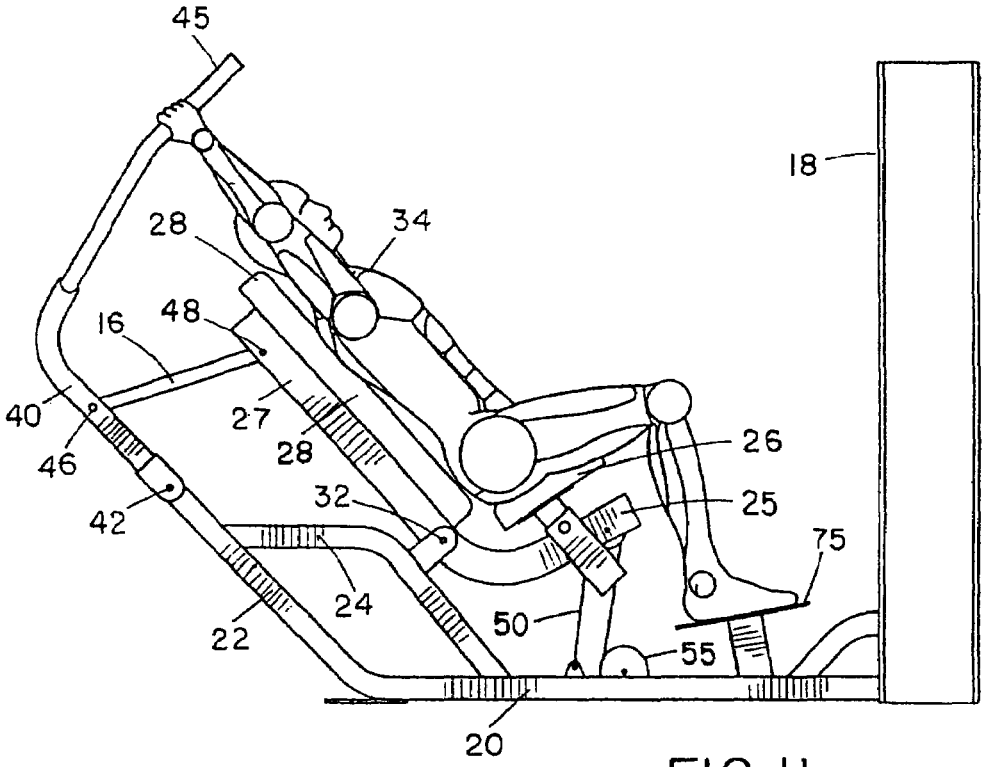
FIG. 11 is a side elevation view of the machine of FIG. 10, illustrating the exercise end position.

FIGS. 10 and 11 illustrate another modification of the machine of FIGS. 1 to 6, in which a single or two-piece foot rest 75 is mounted on the stationary base 20 of the main frame, in front of the user support, replacing the traveling foot plate 30 of the previous embodiments. All other parts of the machine are identical to that of FIGS. 1 to 6, and like reference numerals have been used as appropriate. It can be seen that the stationary foot rest does not detract from the self-aligning benefits of the exercise arm, pivoted user support, and connecting linkage for ensuring that the user support and user pivot rearwards as the user pushes the handles upwardly from the start position of FIG. 10 to the end position of FIG. 11. The movement of the user's upper body and arms with the stationary foot rest is identical to the movement when their feet are supported on the moving foot rest, as can be seen by comparison of FIGS. 5 and 6 with FIGS. 10 and 11. Thus, stationary foot rests may be used to replace the moving foot rests in any of the above embodiments or the embodiments described below.

Figure 12:
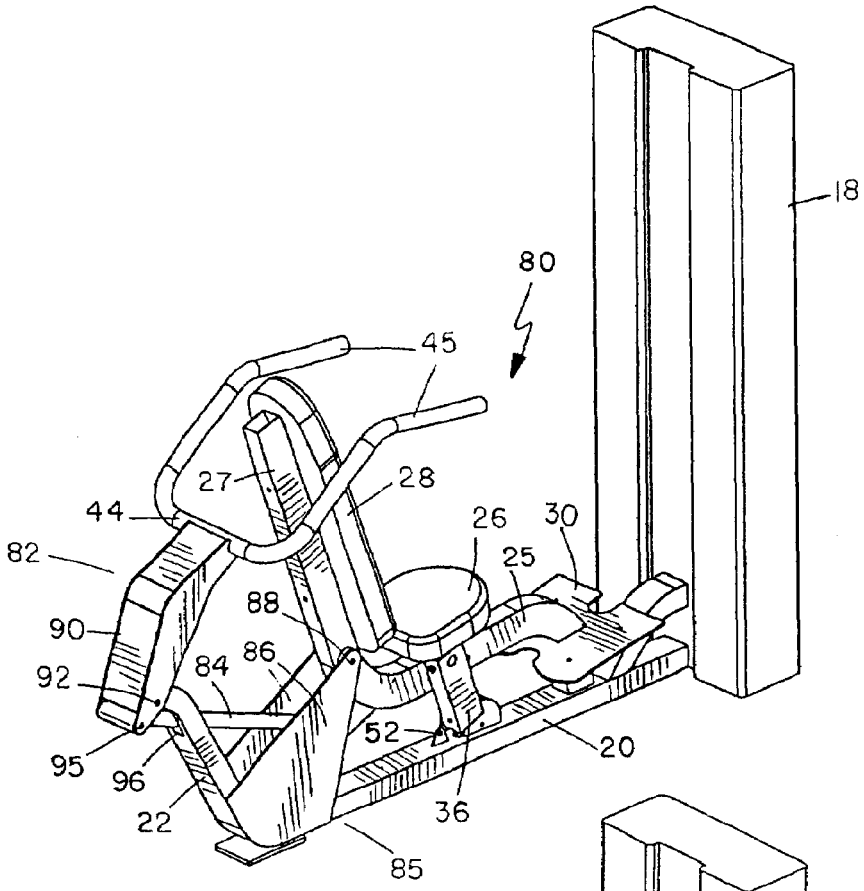
FIG. 12 is a rear perspective view of a shoulder press exercise machine according to another embodiment, illustrating the exercise start position.
Figure 13:
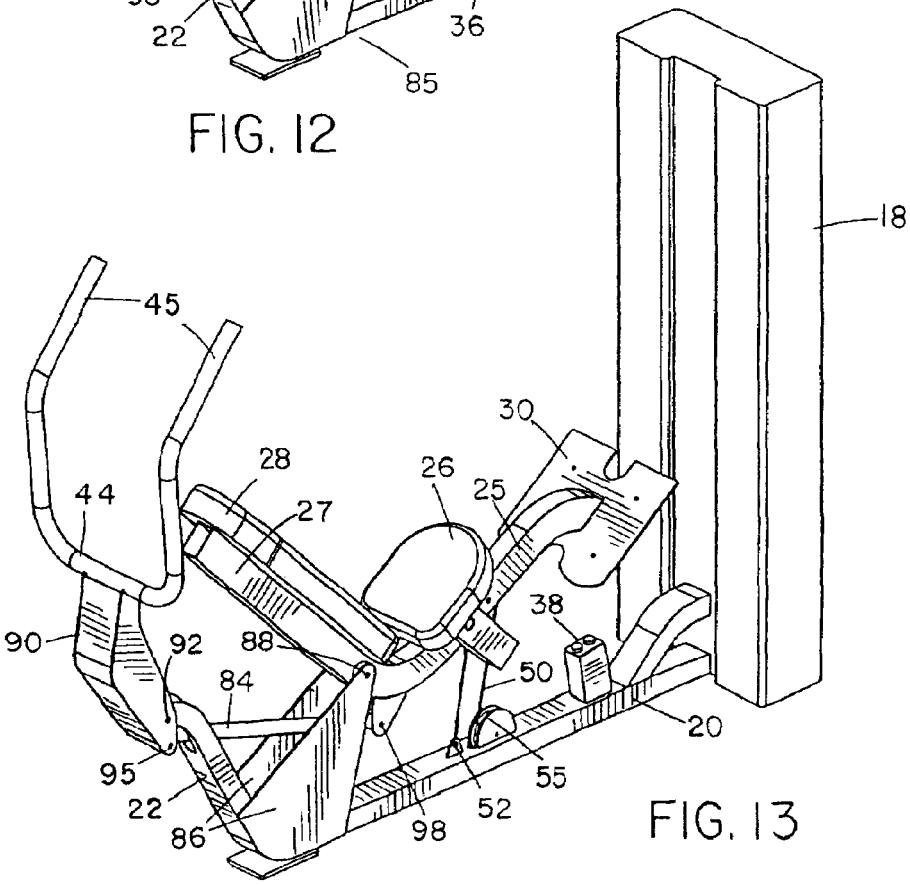
FIG. 13 is a rear perspective view of the machine of FIG. 12, illustrating the exercise end position.

FIGS. 12 and 13 illustrate a shoulder press exercise machine 80 according to another embodiment of the invention. In this embodiment, the connecting link of the previous embodiments, which pulls the top of the user support rearwardly when the exercise arm is raised, is replaced with a connecting link arranged to push the base portion of the user support upwardly and rearwardly. Other parts of the machine are identical to those of the first embodiment, and like reference numerals have been used as appropriate.

As in the first embodiment, the machine 80 has a main frame with a base 20, a rearwardly inclined rear upright strut 22, and a weight stack housing 18 at the forward end of base 20. The user support frame is also substantially the same as in the first embodiment, and is of substantially L-shape with a base 25 on which adjustable seat pad 26 is mounted, an upright 27 on which back pad 28 is mounted, and a foot plate or foot support 30 at the forward, downwardly curved end of the base 25. The base 25 is linked to a weight stack (not visible in the drawings) within housing 18 via cable 50 extending around pulleys 54 and 55, as in the first embodiment. However, in this embodiment, the exercise arm 82, the connecting link 84, and the pivot mount 85 for the user support are modified.

In the embodiment of FIGS. 12 and 13, the user support frame is pivotally mounted on a pair of generally triangular pivot brackets or plates 86 mounted on opposite sides of the rear end of the frame base 20 and extending upwardly and forwardly from the base. The user support frame is pivoted on the upper ends of plates 86 via pivot pin 88. The exercise arm 82 has a first or rear portion 90 which is pivoted to the upper end of strut 22 via pivot 92 spaced from the rear end of portion 90. As in the previous embodiments, the remainder of the exercise arm comprises a U-shaped member with a central portion 44 secured to the upper or forward end of the rear portion 90, and a pair of arms projecting forward from central portion 44 on opposite sides of the user support, in the exercise start position of FIG. 12. The exercise arms each have a handle 45 at their end for gripping by a user.

The lower or rear end of the exercise arm rear portion 90 is pivotally connected to the rear end of the connecting link or arm 84 via pivot 95. The connecting link 84 extends forwardly from pivot 95 through an elongate slot or opening 96 in the rear frame upright 22, and is then pivotally secured to the underside of the user support frame via pivot 98, which is spaced in front of the seat support pivot.

The start and end positions of FIGS. 12 and 13 are exactly the same as the start and end positions of the first embodiment, as illustrated in FIGS. 5 and 6. In the start position, the handles 45 are in a lowered position corresponding to a location below a seated user's chin and in front of their shoulders, while the seat or user support is in a slightly rearwardly reclined position. In order to perform the exercise, the user pushes or presses upwardly while gripping handles 45, rotating the exercise arm in a rearward or anti-clockwise direction about pivot 92. At the same time, the connecting link 84 is pushed forward, pushing the user support and forcing it to rotate rearwardly about the pivot connection 88 to the main frame. In the end position, the handles 45 are located straight above the user's head and in line with the side centerline of the user's body, while the seat is rotated back into a more reclined position. As in the previous embodiments, the controlled seat start and end positions provide proper, supported positioning of the user's body at the start and end of the exercise, as well as throughout the exercise movement. The movement of the user support to track movement of the exercise arm maintains the ideal alignment relationship between the user and the user engaging means or handles on the exercise arms, replicating the natural, gradual rearward arcing arm movement in a traditional, free weight barbell exercise.

Figure 14:
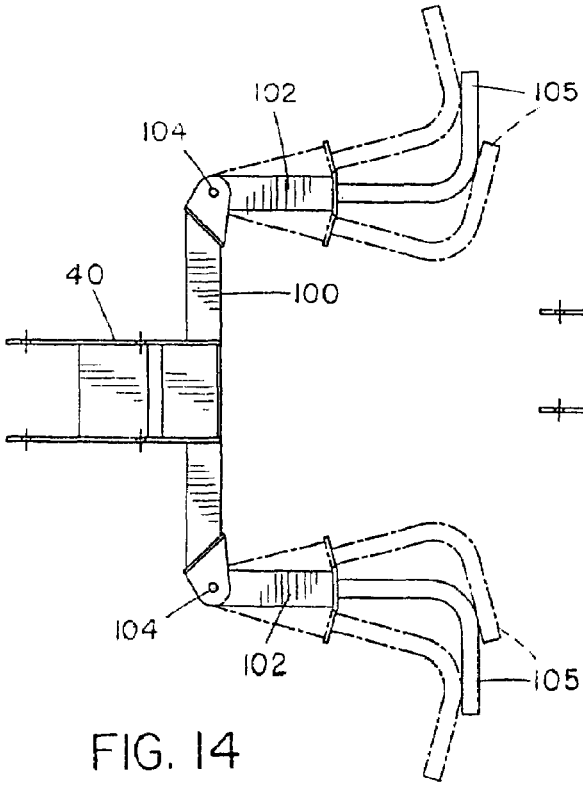
FIG. 14 is a top plan view illustrating modified, pivotally mounted user engaging handles for use in any of the preceding embodiments.
Figure 15:
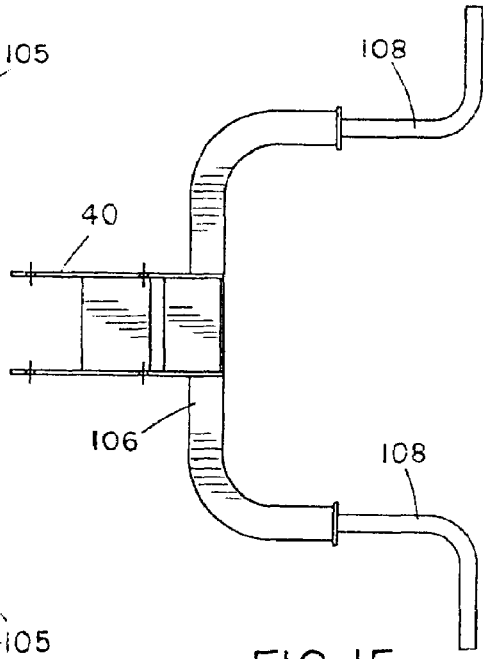
FIG. 15 is a top plan view similar to FIG. 14, illustrating handles similar to those of FIG. 14 in fixed attachment to an exercise arm.

FIGS. 14 and 15 illustrate two possible variations in the exercise arm which provide multiple gripping positions. In the embodiment of FIG. 14, the one-piece, U-shaped arm of the previous embodiments is replaced by a cross bar 100 secured to the end of the rear portion 40 of the exercise arm, and generally L-shaped handle arms 102 which are each pivotally secured to a respective end of cross bar 100 via pivots 104. The gripping ends or handles 105 of the handle arms in this case project outwardly, rather than towards the front end of the machine as in the previous embodiments. The pivotal connection allows the handle arms 102 to swing inwardly or outwardly, as indicated in dotted outline in FIG. 14, and can provide a converging exercise motion as the arms are pressed upward. The exercise arm of FIG. 14 may be used in place of the exercise arms with fixed handles in any of the above embodiments or in the additional embodiments described below. In the alternative of FIG. 15, the straight cross bar 100 of FIG. 14 is replaced with a U-shaped member 106 having L-shaped handles 108 in fixed attachment to opposite ends of member 106. The L-shaped handles provide multiple grip or hand positions, so that the user can grip the handgrips in both inward and forward facing direction. The handle arrangements of FIGS. 14 and 15 duplicate the hand/arm position of a standing military barbell press and the standing or seated dumbbell press, allowing the user's hands to grip the hand grips with their hands in either an inward facing or a forward facing direction, rather than just the inward facing direction as illustrated in FIGS. 5 and 6. However, regardless of whether the handles are as in FIGS. 1 to 13 or as in FIG. 14 or 15, the same basic exercise movement is provided and the same muscles are exercised.

Figure 16:
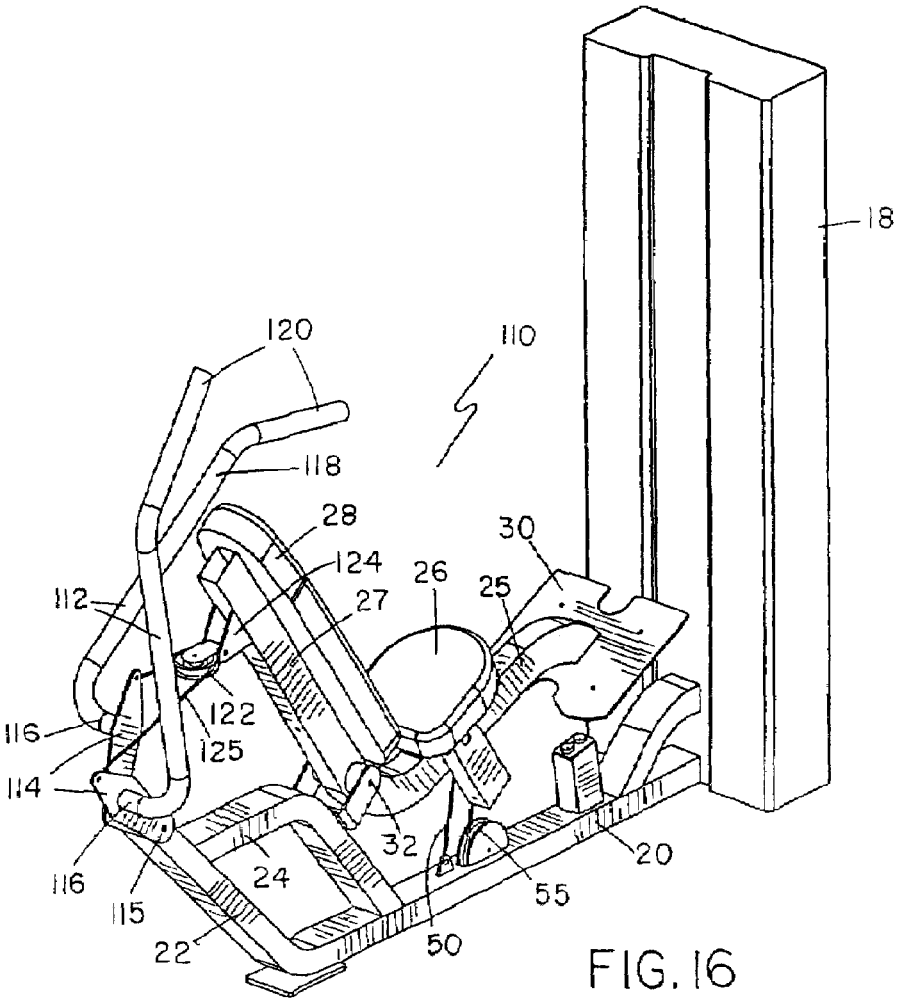
FIG. 16 is a rear perspective view of a shoulder press exercise machine with a split, two-piece exercise arm according to another embodiment, illustrating the exercise end position for one exercise arm and the user support.
Figure 16A:
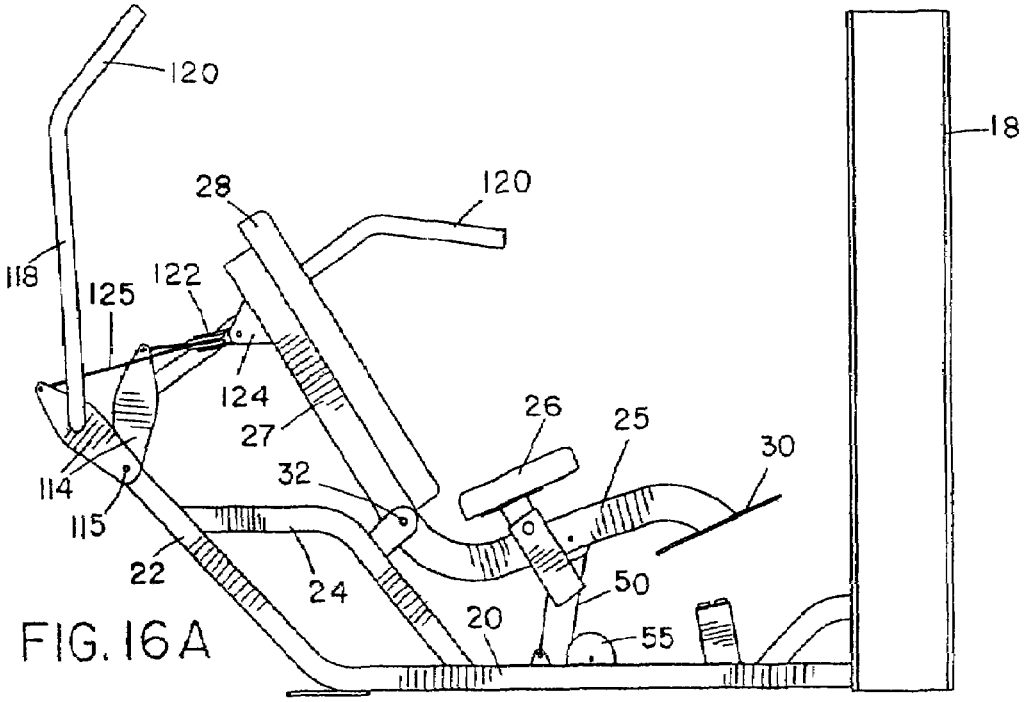
FIG. 16A is a side elevation view of the machine of FIG. 16, also illustrating the exercise end position.

FIGS. 16 and 16A illustrate another modified exercise machine 110 according to another embodiment, which differs from the preceding embodiments since the single piece exercise arm is replaced by a split, two-piece arm. This embodiment is otherwise identical to the first embodiment of FIGS. 1 to 6, and like reference numerals have been used as appropriate. As in the first embodiment, the main frame has a base 20, a rearwardly inclined, rear upright 22, a user pivot mount portion 24, and a weight stack housing 18 at the forward end of the base 20. The user support frame is also identical to the first embodiment, having a base 25 on which a height adjustable seat pad 26 is mounted, an upright 27 on which a back support pad 28 is mounted, and a foot support or plate 30 at the forward end of base 25. The user support frame is pivotally mounted on the main frame pivot mount portion 24 via pivot mount 32, and is linked to the weight stack via a cable and pulley assembly identical to the first embodiment.

In this embodiment, as noted above, the single exercise arm of the previous embodiments is replaced by separate exercise arms 112 for independent arm movement by the user. Each exercise arm 112 has a rear pivot bracket 114 pivoted at one end to the upper end of the rear frame strut 22 via pivot 115, and an elongate arm portion having an inwardly curved rear end 116 secured to an intermediate point on the pivot bracket 114, and a forwardly projecting portion 118 having a handle or hand grip 120 at its forward end. Each pivot bracket 114 is connected to the upper end of the user support upright 27 by a cable and pulley assembly. The cable and pulley assembly or linkage comprises a pulley 122 pivotally mounted on a pivot bracket 124 at the upper end of the user support upright 27, and a flexible line or cable 125 reeved through the pulley 122 and connected to the upper ends of the exercise arm pivot brackets 114.

When one or both of the exercise arms 112 is pressed upwards, the line 125 pulls the user support rearward about its pivotal connection 32 to the main frame, towards the rearwardly reclined end position of FIGS. 16 and 16A. When both exercise arms 112 are in the lower, start position illustrated for the rearmost arm in FIGS. 16 and 16A, the user support is in the less reclined, start position of FIG. 5. This arrangement provides equal resistance to each of the user's arms and provides a more balanced workout. It allows the user to work one arm at a time and requires more coordination when both arms are worked together. If only one arm is moved, the resistance is halved and the user support moves half of the distance towards the end position. If both arms are pressed upwards together, the user support is moved to the end position. The handles of FIGS. 16 and 16A may be replaced by the alternative handle arrangements of FIG. 14 or 15, if desired.

Figure 17:
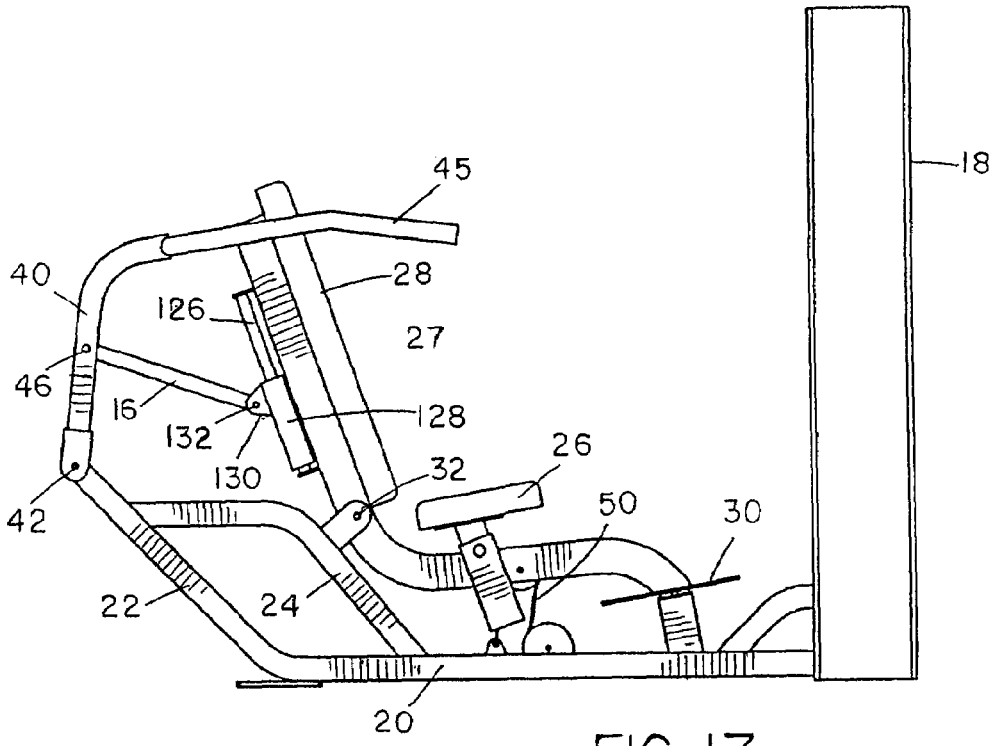
FIG. 17 is a side elevation view of a modified shoulder press exercise machine, illustrating the exercise start position.
Figure 18:
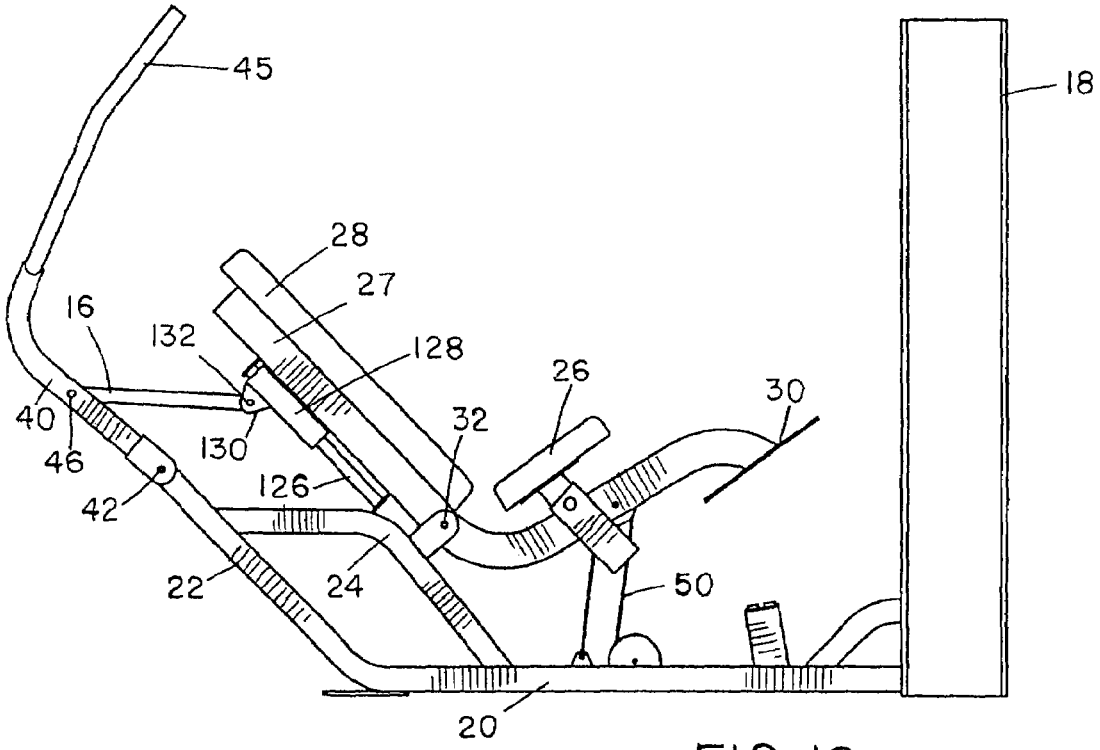
FIG. 18 is a side elevation view of the machine of FIG. 17, illustrating the exercise end position.

FIGS. 17 and 18 illustrate another modification of the machine of FIGS. 1 to 6, and like reference numerals have been used for like parts as appropriate. The main difference between this embodiment and that of FIGS. 1 to 6 is that the direct pivotal connection of the connecting link 16 to the user support upright 27 is replaced with a linear slide connection. In this embodiment, a guide rail 126 is secured to the rear side of the user support upright 27, and a linear slide member 128 is slidably mounted on the guide rail 126. The connecting link 16 is pivoted at one end to the rear strut or portion 40 at pivot 46, as in the embodiment of FIGS. 1 to 6, but the opposite end is pivoted to a mounting bracket 130 on the slide member 128, via pivot 132.

Again, the exercise start and finish position of FIGS. 17 and 18, respectively, is identical to that of FIGS. 5 and 6. In the start position of FIG. 17, the slide member 128 is at the lower end of the guide rail or track 126, and the exercise arm is in the lowered, start position. As the exercise arm is pressed upwards, the slide member moves up the guide bar, forcing the user support to rotate rearward into the rearwardly reclined end position of FIG. 18.

Figure 19:
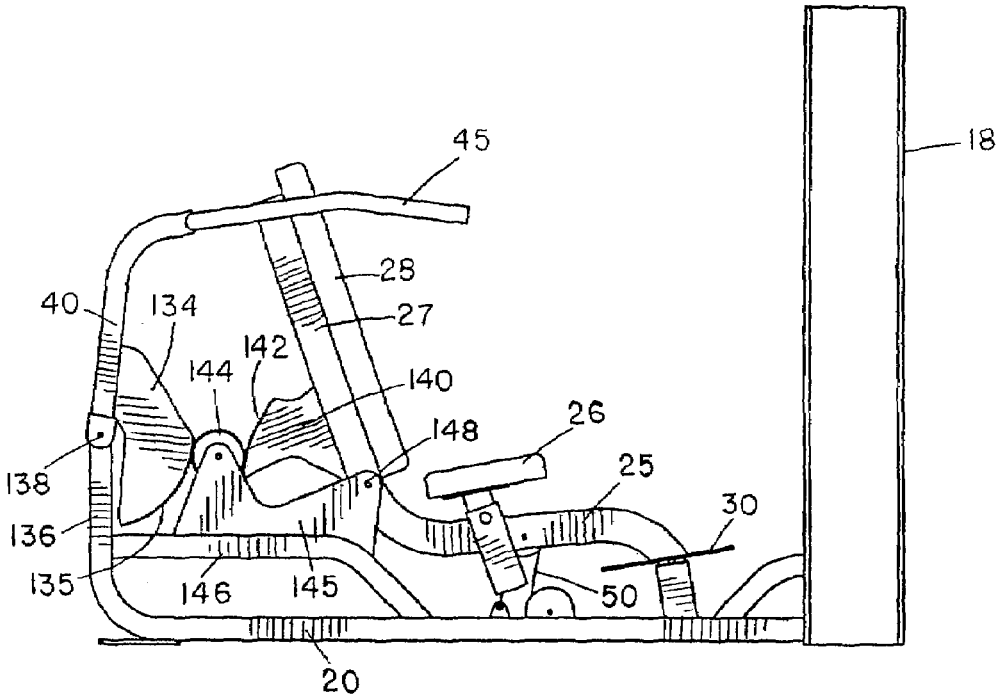
FIG. 19 is a side elevation view of a shoulder press exercise machine according to another embodiment, illustrating the exercise start position.
Figure 20:
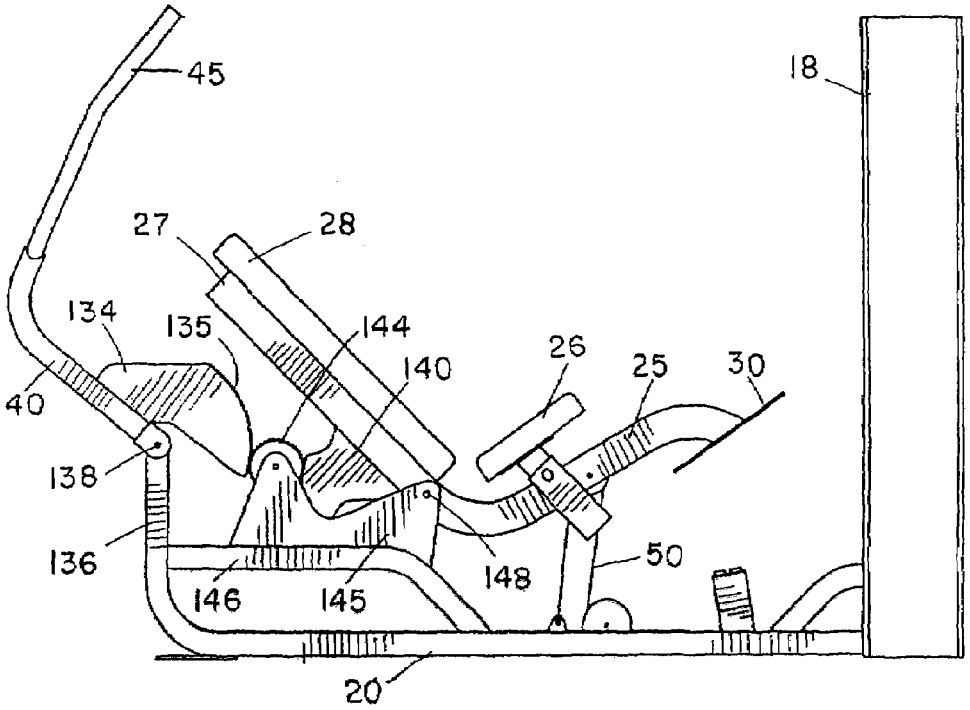
FIG. 20 is a side elevation view of the machine of FIG. 19, illustrating the exercise end position.
Figure 21:
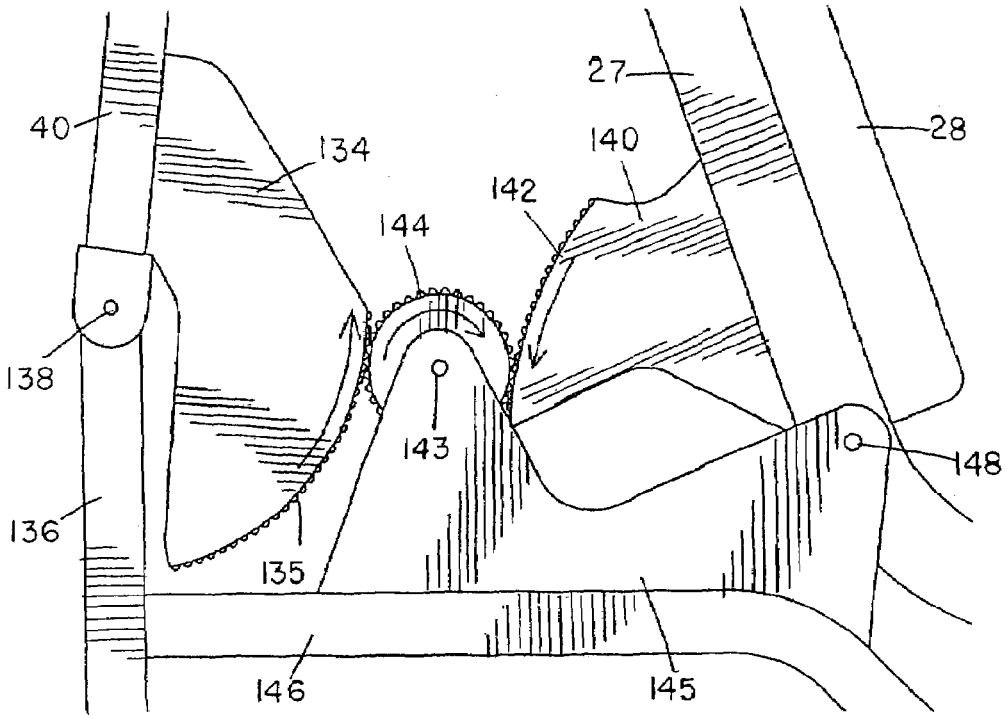
FIG. 21 is a close-up view of the interlocking gears of the machine of FIGS. 19 and 20.

FIGS. 19 to 21 illustrate a modified version of the machine of FIGS. 1 to 6, in which geared cams are used in place of the pivoted connecting link 16 to translate upward motion of the exercise arm into rearward rotation of the user support. FIG. 21 is an enlarged view illustrating the interlocking gears of the connecting link of FIGS. 19 and 20 in more detail. The parts are otherwise identical to the machine of FIGS. 1 to 6, and like reference numerals have been used as appropriate.

A first geared cam 134 with gear teeth extending along arcuate edge 135 is mounted on the rear strut or portion 40 of the exercise arm 15, which in turn is pivoted to the upper end of the frame rear upright 136 at pivot 138. In this case, the rear upright 136 extends substantially vertically and is not rearwardly inclined, as was the case with rear upright 22 of the first embodiment. A second geared cam 140 with gear teeth extending along arcuate edge 142 is mounted on the rear of the user support upright 27. A matching geared sprocket 144 is rotatably mounted on pivot 143 on a rear portion of a mounting bracket 145 secured to a generally horizontal pivot mount portion 146 of the main frame. Teeth on the arcuate edges 135, 142 of the cams 134, 140, respectively, mesh with teeth on the sprocket 144, as best illustrated in FIG. 21. The user support frame 14 is also rotatably mounted on the mounting bracket 145 at pivot mount 148 at the forward end of the mounting bracket 145, with the pivot connection being at an equivalent position on the user support frame 14 to the pivot connection 32 of the first embodiment.

The exercise movement in this case is also identical to that illustrated in FIGS. 1 to 6 above, with the same general start and finish position for the user, user support frame, and exercise arm. In this case, the geared cams 134 and 142 and the sprocket 144 start in the position illustrated in FIGS. 19 and 21. As the exercise arm handles 45 are pushed upward, the geared cam 134 rotates in the direction of the arrow in FIG. 21 about its pivotal connection 138 to the main frame. This causes the geared sprocket 144 to rotate in a clockwise direction about pivot 143, as also indicated by the arrow on the sprocket in FIG. 21. This, in turn, causes the geared cam 140 on the user support to rotate anti-clockwise in the direction of the arrow in FIG. 21, forcing the user support to rotate rearward about pivot connection 148 into the end position of FIG. 20.

Figure 22:
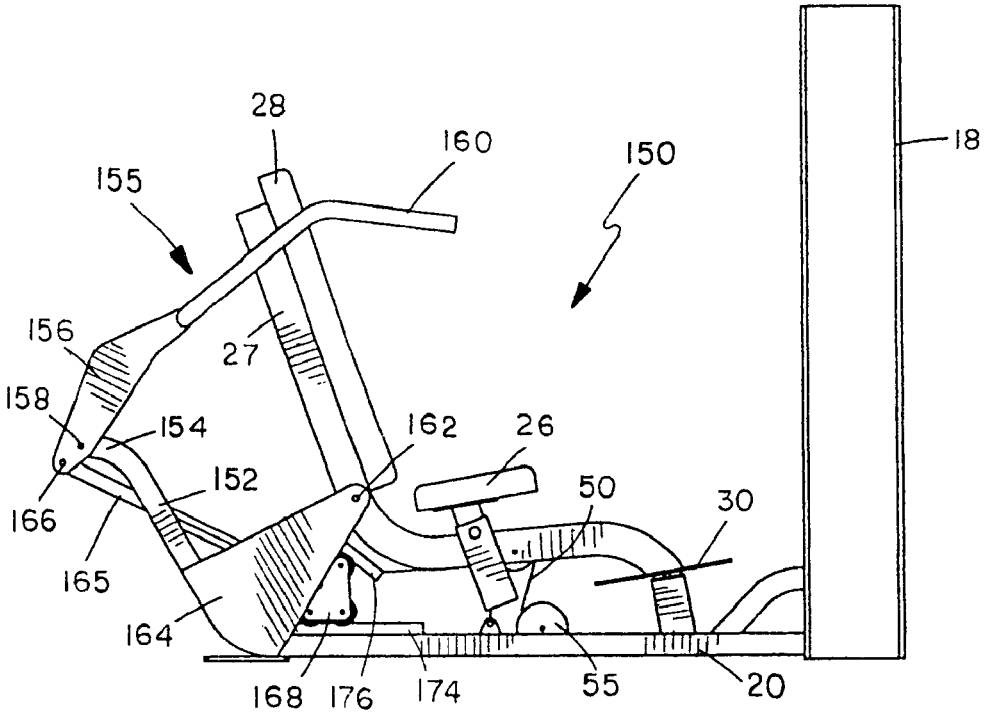
FIG. 22 is a side elevation view of another modified shoulder press exercise machine, illustrating the exercise start position.
Figure 23:
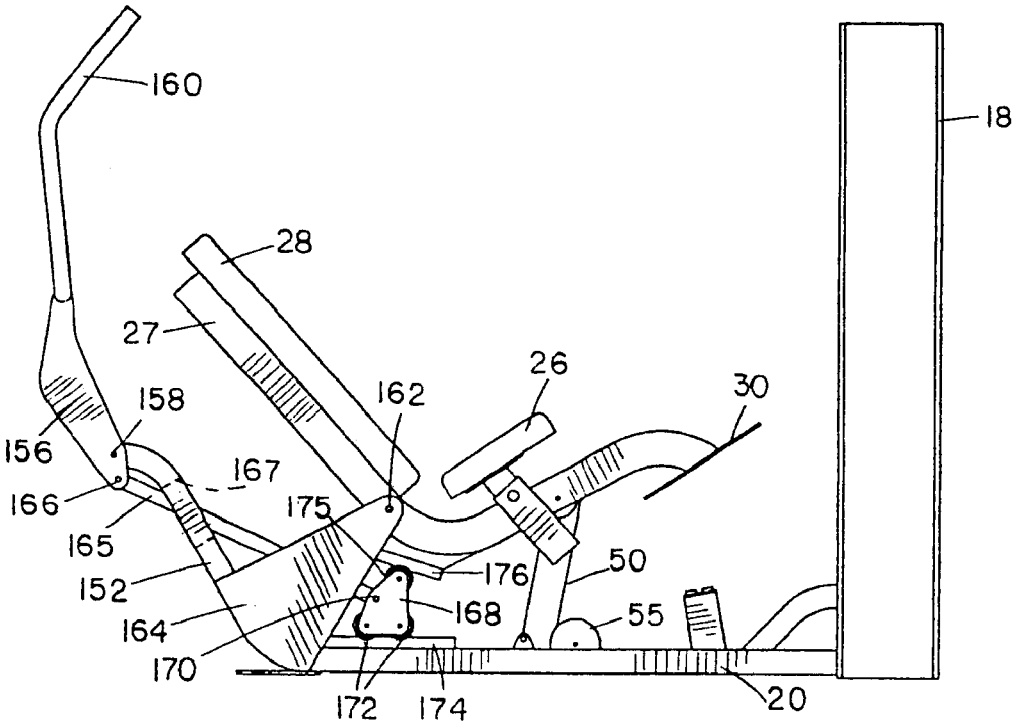
FIG. 23 is a side elevation view of the machine of FIG. 22, illustrating the exercise end position.

FIGS. 22 and 23 illustrate another modified exercise machine 150 which has a modified connecting linkage between the user support and exercise arm. The machine of FIGS. 22 and 23 is otherwise similar or identical to that of FIGS. 1 to 6, and like reference numerals have been used for like parts as appropriate. The exercise movement in this case is also identical to that of FIGS. 1 to 6, with the user, user support, and exercise arm adopting the same positions as illustrated in FIGS. 5 and 6 in the exercise start and finish positions.

In the embodiment of FIGS. 22 and 23, the main frame has a rear upright 152 which is modified in shape to have a rearwardly curved end portion 154. The exercise arm 155 is pivotally connected to the main frame via pivot brackets 156, which are pivotally secured to the rear end of the frame rear upright 152 at pivot 158, and which are connected to the mid point of a U-shaped member similar to the U-shaped member of FIGS. 1 to 6. However, the handles or hand grips 160 of the U-shaped member are bent at a greater angle to the remainder of the handle arms than the handles of the first embodiment, as can be seen in the drawings. The user support 14, which is substantially identical to that of the first embodiment, is pivotally supported via pivot 162 on the upper ends of spaced pivot mounting brackets 164 secured to the main frame.

A connecting link or bar 165 is pivoted at one end to the lower ends of the pivot brackets 156 via pivot 166, and extends in a forward direction through an opening 167 in the rear upright 152 and between the pivot mounting brackets 164. The forward end of the link 165 is pivoted to a rolling wedge member 168 at pivot 170. The rolling wedge member has a first pair of rollers 172 in rolling engagement with a track or guide 174 on the frame base member 20, and an upper roller 175 in rolling engagement with an inclined guide or track 176 located on the undersurface of the user support frame at the junction between the base 25 and upright 27. This linkage is similar to that described in co-pending application Ser. No. 10/195,665 filed Jul. 12, 2002, the contents of which are incorporated herein by reference.

As illustrated in FIG. 22, in the start position, the rolling wedge 168 is located towards the rear end of the guide track 174, and the exercise arm 155 is in the lowered, start position which is just below the chin and in front of the shoulders of a user seated on the user support seat pad 26 with their back against back pad 28. As the exercise arm is pushed upward to the finish position of FIG. 23, the lower end of the pivot brackets 156 pivots inwardly in an anti-clockwise direction about pivot 158, simultaneously pushing the connecting link 165 forward. The opening 167 in the frame upright 152 is elongated to permit this motion. The connecting link 165 in turn pulls the rolling wedge 168 forward along tracks 174 and 176, forcing the user support to rotate rearward into a more rearwardly inclined position. Thus, the exercise movement in this embodiment is exactly the same as in the previous embodiments, and the combined exercise arm and user support movement provides a self-aligning exercise motion that allows the user to start with their hands slightly forward of their shoulders, yet finish directly overhead with their arms in line with the side centerline of their body.

Figure 26:
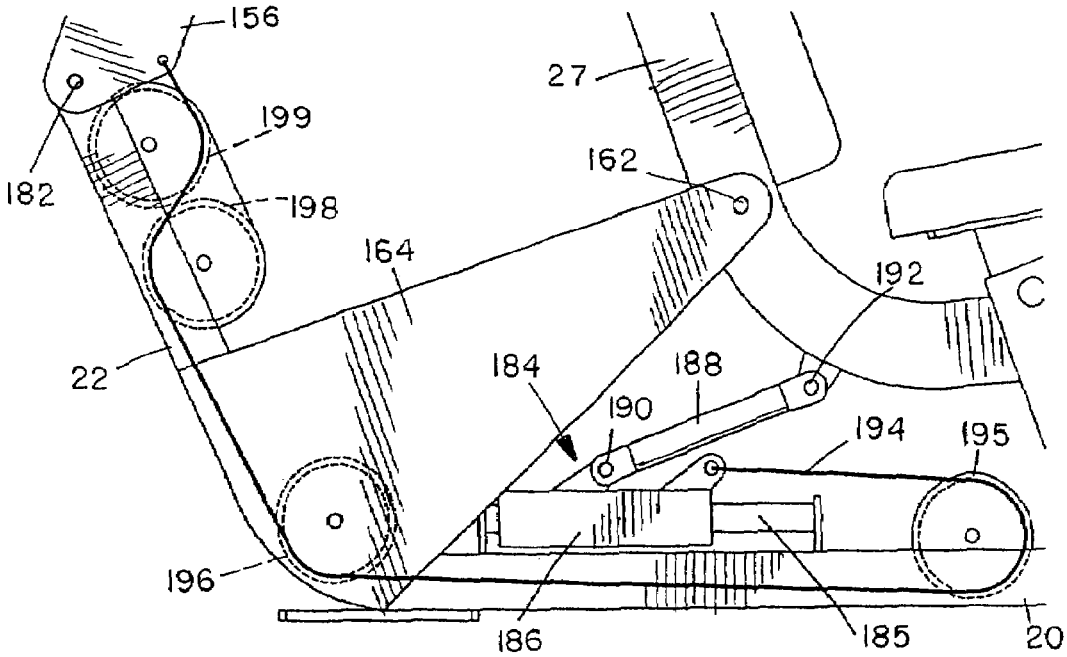
FIG. 26 is an enlarged, more detailed view of the connecting linkage of the machine of FIGS. 24 and 25.
Figure 24:
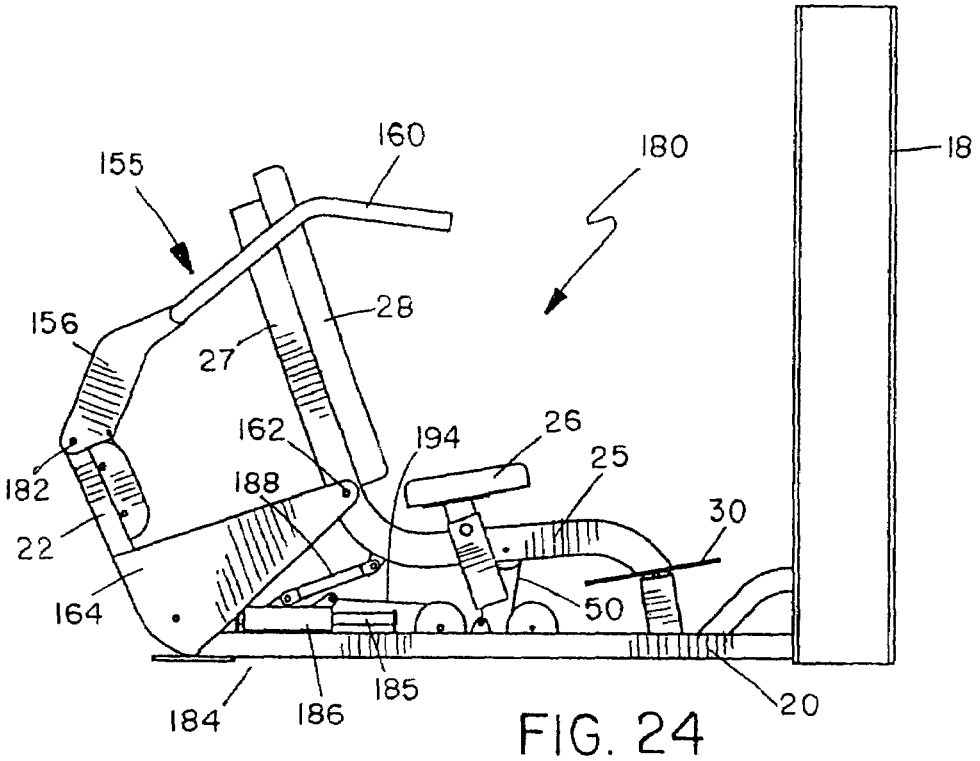
FIG. 24 is a side elevation view of a modified shoulder press exercise machine according to another embodiment, illustrating the exercise start position.
Figure 25:
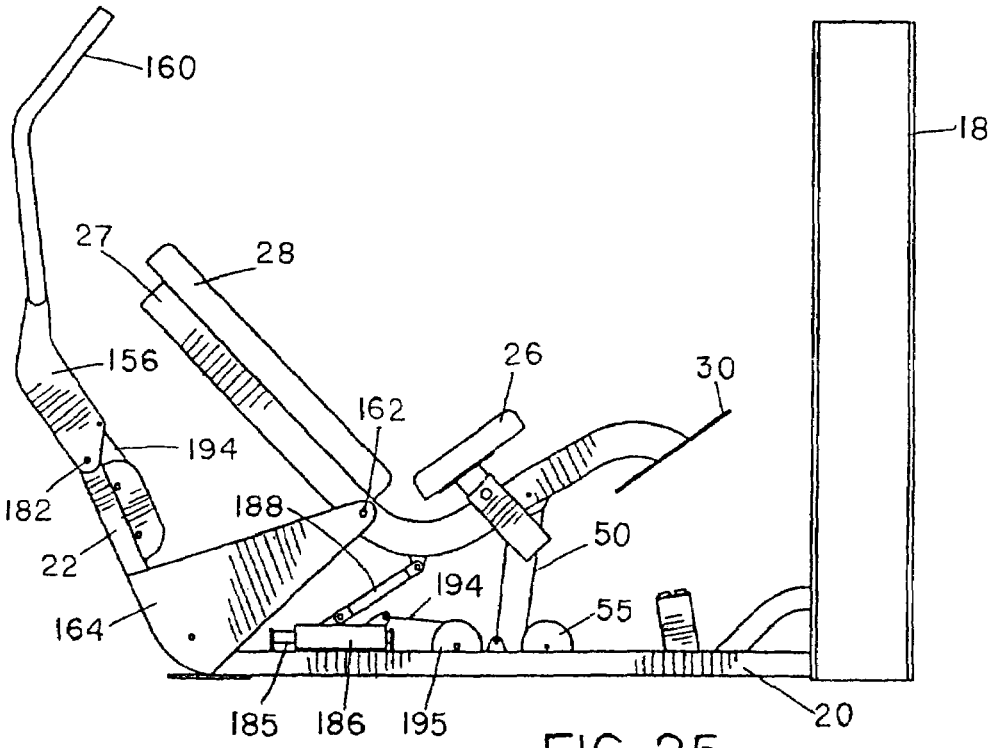
FIG. 25 is a side elevation view of the machine of FIG. 24, illustrating the exercise end position.

FIGS. 24 to 26 illustrate an exercise machine 180 according to another embodiment, which has a modified connecting linkage between the exercise arm and the user support. Other parts of the machine are the same as in previous embodiments, and like reference numerals have been used for like parts as appropriate.

In this case, the user support pivot mount is identical to that of FIGS. 22 and 23, comprising a pair of spaced pivot mounting plates or brackets 164, with the user support pivotally mounted at the upper, forward ends of the plates via pivot pin 162, located on the upright 27 of the user support adjacent the junction with the user support base 25. The exercise arm 155 is also identical to the previous embodiment, having pivot brackets 156 and a U-shaped arm with a central portion secured to the upper ends of pivot brackets 156, and angled handles 160 at its forward ends. However, in this case, the lower end of the pivot brackets are pivotally mounted at the upper end of the frame rear upright 22 via pivot 182, and the brackets 156 are linked to the user support via a sliding linkage system 184, which is illustrated in more detail in FIG. 26. This sliding linkage system is similar to the one described in co-pending application Ser. No. 10/171,236 filed Jun. 12, 2002, the contents of which are incorporated herein by reference.

The sliding linkage system 184 includes a guide bar 185 mounted on top of the base section 20 of the main frame, and acting as a runner for a slide member 186, which may be a linear bearing, wheel, or the like. A connecting link 188 is pivotally connected at its first end to the slide member via pivot 190, and at its second end to the underside of the elongated base section 25 of the user support via pivot 192. The exercise arm 155 is connected to the slide member 186 by a cable and pulley system comprising a cable 194 having a first end anchored to the slide member, and extending around a first pulley 195 on the base 20 of the frame at a location spaced in front of the guide bar 185, then back through the base 25 and around a pulley 196 mounted between the pivot mounting brackets 164, and then around the double pulleys 198,199 before being anchored to the pivot brackets 156 of the exercise arm 155 at a location in front of the exercise arm pivot 182.

As illustrated in FIG. 24, in the start position of the exercise arm and user support, the slide member 186 is at the rear end of the guide bar 185. The user sits on the user support with their hands gripping handles 160, and then pushes upwardly to rotate the exercise arm 155 upwardly and rearwardly about pivot 182 into the finish position of FIG. 25, in which the user's arms extend straight above their head and in line with the side centerline of their body. At the same time, upward movement of the exercise arm translates into forward movement of the slide member 186, since the cable 194 is also pulled up and therefore pulls the slide member forwards. This causes the connecting link 188 to pivot about its connection to the slide member and user support. This action forces the user support to lift and rotate rearward about its pivot connection 162 to the main frame. Thus, the user support tracks movement of the exercise arm in exactly the same path as the previous embodiments, guiding and supporting the exerciser to maintain the proper body positioning and alignment throughout the exercise.

Figure 27:
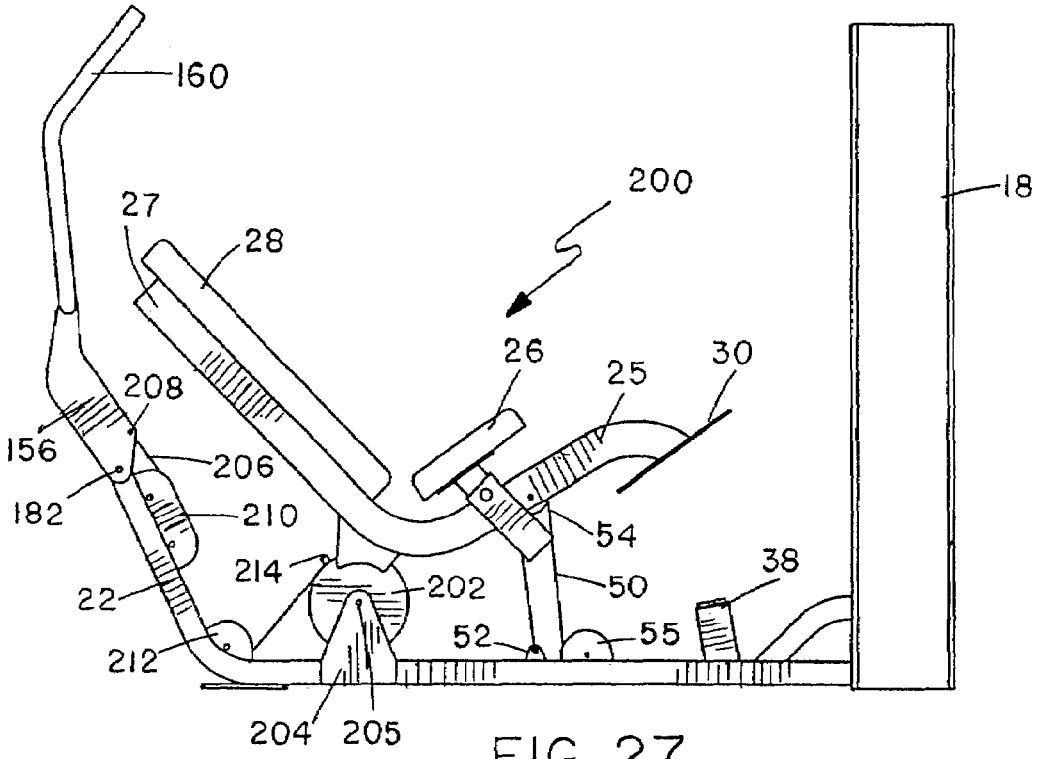
FIG. 27 is a side elevation view of a shoulder press exercise machine according to another embodiment, illustrating the exercise end position.
Figure 28:
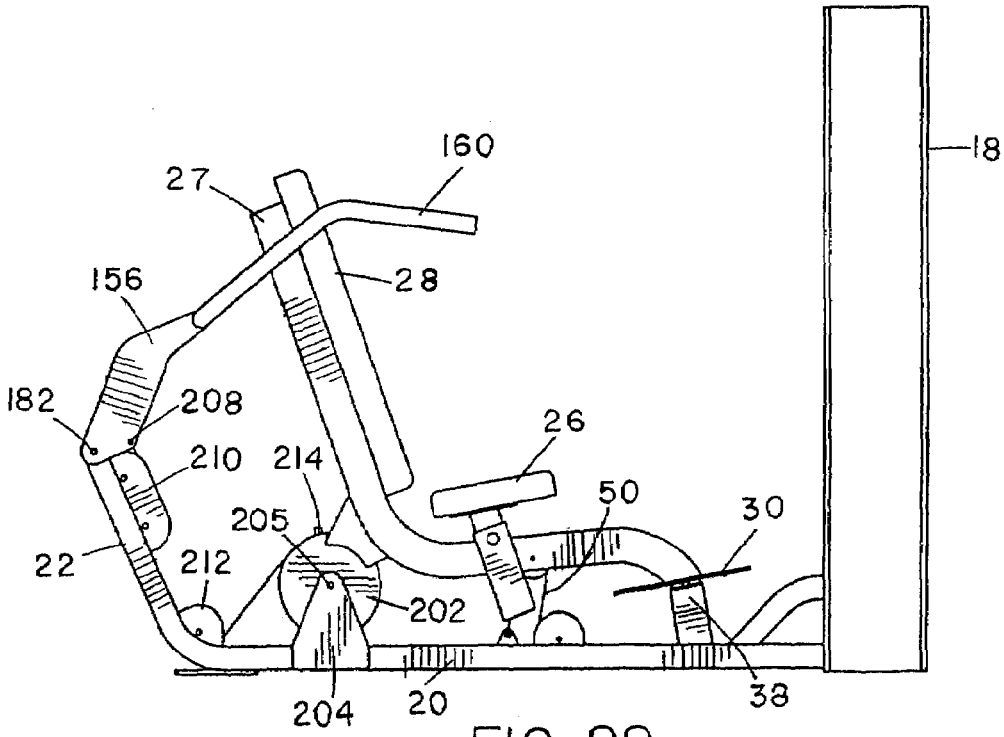
FIG. 28 is a side elevation view of the machine of FIG. 27, illustrating the exercise start position.

FIGS. 27 and 28 illustrate another modified shoulder press exercise machine 200 in which the user support pivot mount and the connecting link between the exercise arm and user support are modified. Other parts of the machine 200 are identical to those in previous embodiments, and like reference numerals have been used for like parts as appropriate.

In this embodiment, the main frame 12 and user support 14 are identical to the first embodiment, while the exercise arm 155 is similar to the embodiments of FIGS. 22 to 25. Main frame 12 has a base 20 with a rearwardly inclined, rear upright 22 and a weight stack housing 18 at its forward end. The exercise arm 155 has a first rear or lower portion comprising a pair of pivot plates or brackets 156 similar to FIGS. 22 to 25, and a U-shaped forward portion having a central region secured to the upper ends of the pivot brackets 156, with a pair of forwardly projecting handle arms having suitably angled handles 160 at their forward ends. The lower ends of brackets 156 are pivotally mounted at the upper end of upright 22 via pivot 182, as in the previous embodiment. User support frame 14 has a base 25 on which seat pad 26 is adjustably mounted, a rear upright 27 on which a back pad 28 is mounted, and a foot plate or support 30 at the forward end of base 25. The base of the user support frame is linked to the weight stack via a cable and pulley system as in the first embodiment.

The user support is secured to a round cam 202 which in turn is pivotally mounted on a pivot mount 204 on the base 20 of the main frame via pivot 205. This replaces the direct pivot mount of the user support as in the previous embodiments. The exercise arm 155 is linked to the round cam 202 via a cable and pulley system comprising a cable 206 extending from anchor 208 on the exercise arm pivot brackets 156, around a double pulley device 210 on the rear upright strut 22 of the main frame, and then reeving around a pulley 212 at the junction between strut 22 and base 20 before extending to an anchor 214 on the round cam.

The start position of the machine 200 is illustrated in FIG. 28. As in the previous embodiments, the user sits on the user support seat in the start position, and grips the handles 160 which are positioned just in front of his or her shoulders. They then push the handles, and thus the exercise arm 155, upwardly and rearwardly about pivot 182. This in turn pulls on cable 206, which forces the round cam 202 to rotate in an anti-clockwise direction, causing the user support 14 to pivot rearward into the end position of FIG. 27. Again, the exercise movement is substantially identical to the previous embodiments, with the user supported in the proper orientation throughout the exercise and aligned to the position of the exercise arm throughout the entire travel path.

Figure 29:
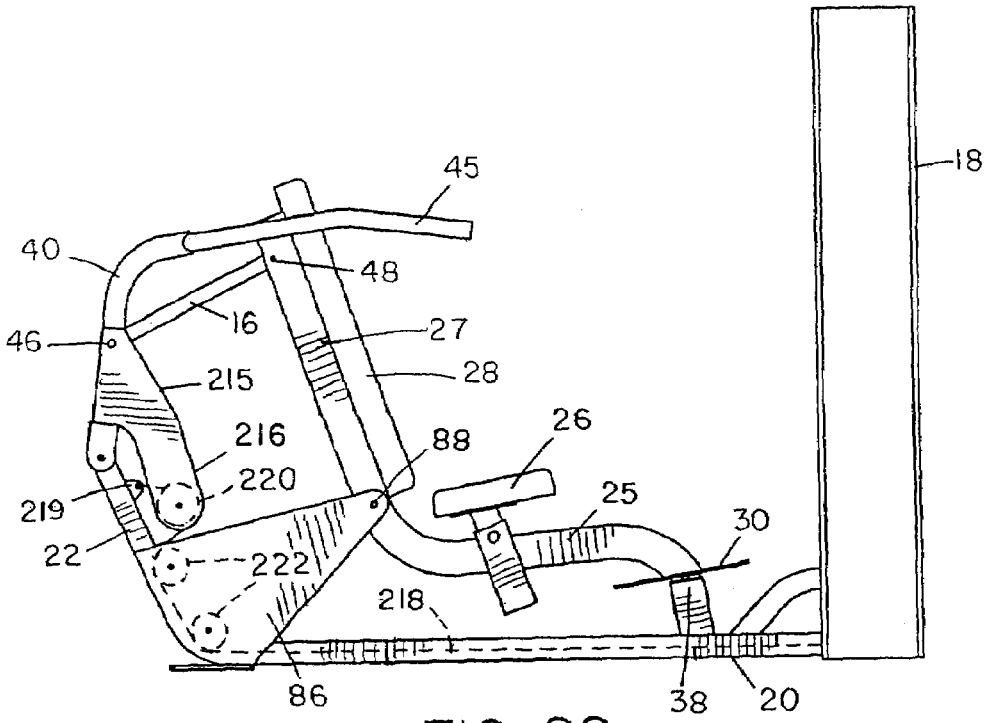
FIG. 29 is a side elevation view of a modified shoulder press exercise machine, illustrating the exercise start position.
Figure 30:
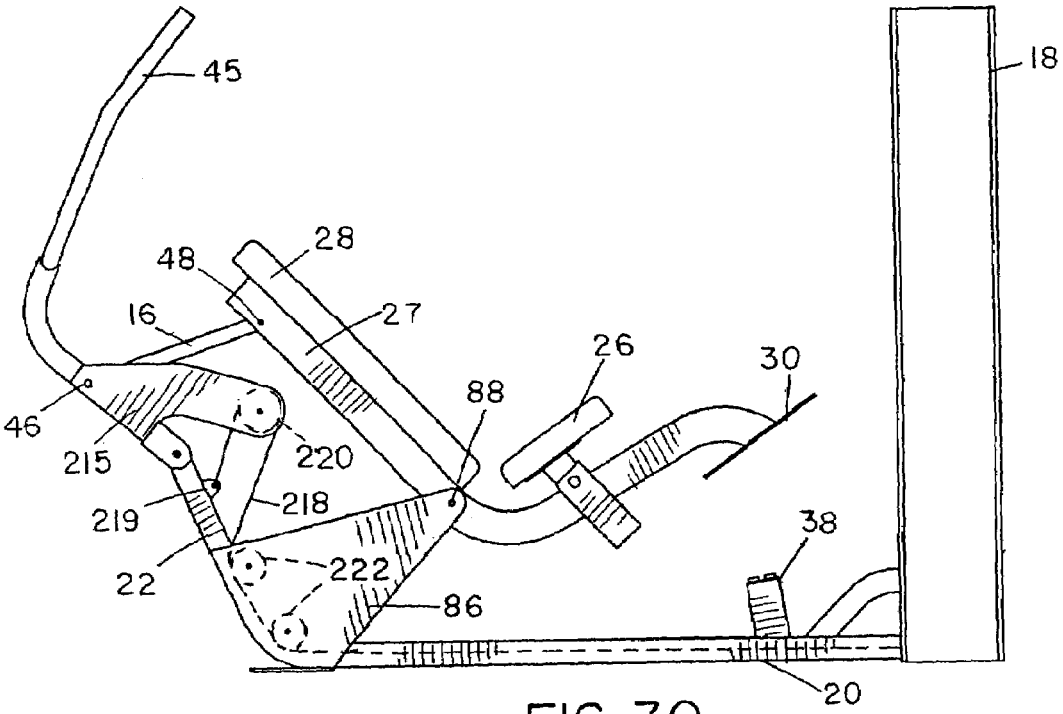
FIG. 30 is a side elevation view of the machine of FIG. 29, illustrating the exercise end position.

In the embodiment of FIGS. 29 and 30, the exercise resistance or load is linked to the exercise arm, rather than to the user support as in all the previous embodiments. The exercise resistance, whether a weight stack as in FIGS. 29 and 30, weight plates, or other type of resistive load, in any of the previous embodiments may also be linked to the exercise arm rather than the user support, if desired. The other parts of the machine of FIGS. 29 and 30 are the same as in one or more of the previous embodiments, and like reference numerals are used for like parts as appropriate.

The main frame 12 and user support 14, as well as the majority of the exercise arm 15 and the connecting link 16 between the exercise arm and user support, are the same as in the first embodiment of FIGS. 1 to 6, while the user support pivot mount comprises spaced pivot brackets 86 as in the embodiment of FIGS. 12 and 13, with a pivot connection 88 between the upper ends of the pivot brackets and the underside of the user support. However, a pair of extended pivot brackets 215 are mounted on opposite sides of the rear strut 40 of exercise arm 15. The pivot brackets 215 have a downwardly extending portion 216 linked to the weight stack via a cable and pulley system comprising a cable 218 extending from an anchor 219 on the rear frame strut 22, around a pulley 220 rotatably mounted between the end portions 216 of the exercise arm pivot brackets 215, and then around pulleys 222 mounted between the user support pivot mount brackets 86 before extending through the base 20 of the main frame and into the weight stack housing.

The start position of the modified machine is illustrated in FIG. 29, and is equivalent to the start positions of the previous embodiments, with the user support 14 in a slightly rearwardly reclined orientation, and the exercise arm 15 in a lowered position with the handles 45 at a location which would be just in front of the shoulders and below the chin of a user seated on the user support with their back resting against back pad 28. The user pushes up on the handles 45 in order to perform the exercise, rotating the exercise arm upwardly and rearwardly, and pulling the resistive cable 218 so as to lift the selected weights in the weight stack. At the same time, movement of the exercise arm 15 is linked to the user support 14 by the pivoted connecting link 16 in exactly the same way as the first embodiment, so that the upright 27 is pulled back and the user support is forced to rotate rearwardly about pivot 88 into the more rearwardly reclined position of FIG. 30. This modified exercise machine therefore moves in exactly the same way as in the previous embodiments and has the same advantages of proper support of the user throughout the exercise movement, while accurately simulating the upper body motion of a free weight shoulder press exercise.

Figure 31:
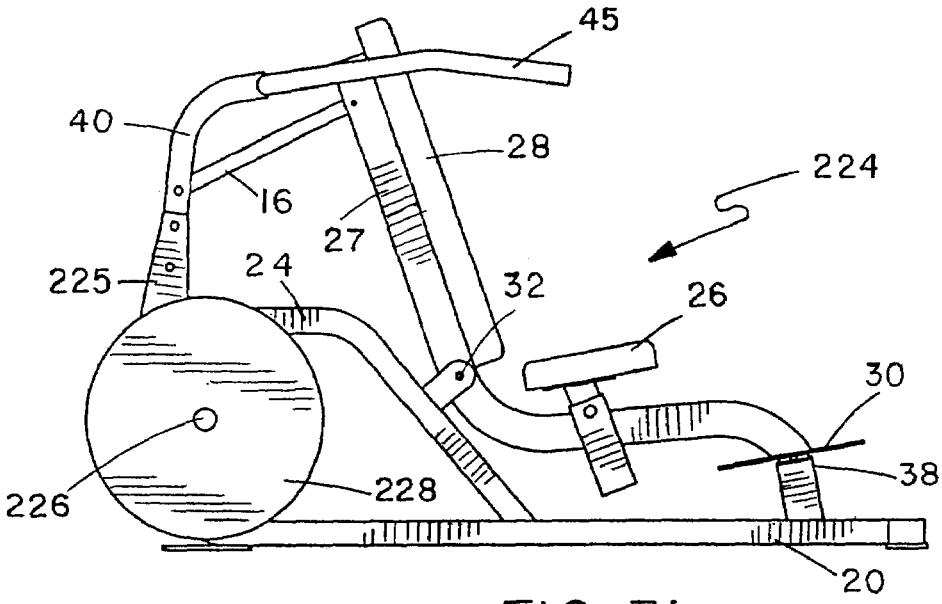
FIG. 31 is a side elevation view of a shoulder press exercise machine according to another embodiment, illustrating the exercise start position.
Figure 32:
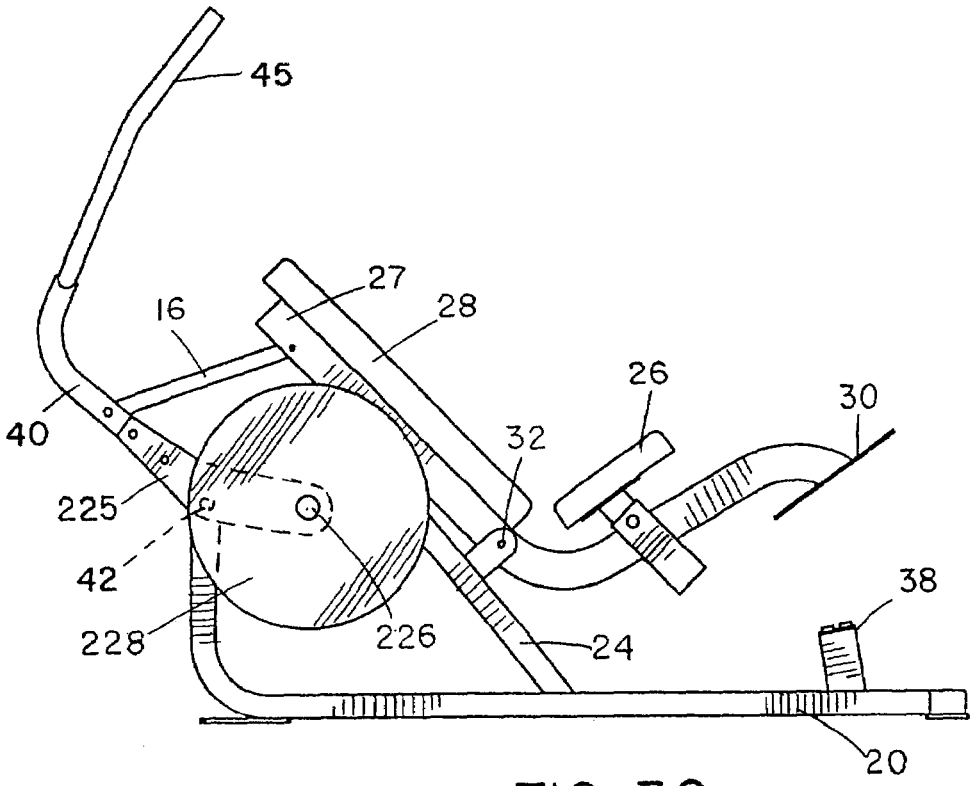
FIG. 32 is a side elevation view of the machine of FIG. 31, illustrating the exercise end position.

FIGS. 31 and 32 illustrate a modified exercise machine 224 which is similar to the machine of FIGS. 29 and 30 but replaces the weight stack exercise resistance with a plate-loaded resistance. This is similar to the difference between the embodiment of FIGS. 1 to 6 and that of FIGS. 7 and 8, except that those embodiments have the exercise resistance associated with the user support, whereas this embodiment and that of FIGS. 29 and 30 have the exercise resistance associated with the exercise arm. Other parts of the machine 224 are identical to parts in one or more previous embodiments, and like reference numerals have been used for like parts as appropriate.

In this embodiment, the exercise arm 15 has a pair of downward extension plates 225 extending downwardly from rear strut 40 in the start position of FIG. 31. Plates 225 are pivoted to the upper end of frame rear upright 22 (which is vertical rather than rearwardly inclined) at pivot 42, and project downwardly from the pivot 42 on opposite sides of the strut 22. Weight supporting pegs 226 project in opposite directions from the ends of plates 225, and a selected number of weight plates 228 can be loaded on the pegs 226.

In the start position of FIG. 31, the weight plates 228 rest in a lowered position near the ground while the forward end (foot plate 30) of the user support rests on stop pad 38. The positions of the exercise arm 15 and user support 14 are identical to the start positions of these parts in the previous embodiments. Again, the seated user grips the handles 45 and pushes upwardly, rotating the exercise arm 15 upwardly and rearwardly, and lifting the weight plates 228 into the raised position of FIG. 32. At the same time, connecting link 16 pulls the upper end of the user support rearwardly, rotating the user support about pivot 32 into the more rearwardly reclined end position of FIG. 32. Again, in this position, the user's arms extend straight above their head in line with the side centerline of their body, mimicking the upper body end position of a free weight shoulder press exercise. This modified machine therefore also has all the advantages described above in connection with the previous embodiments.

Figure 33:
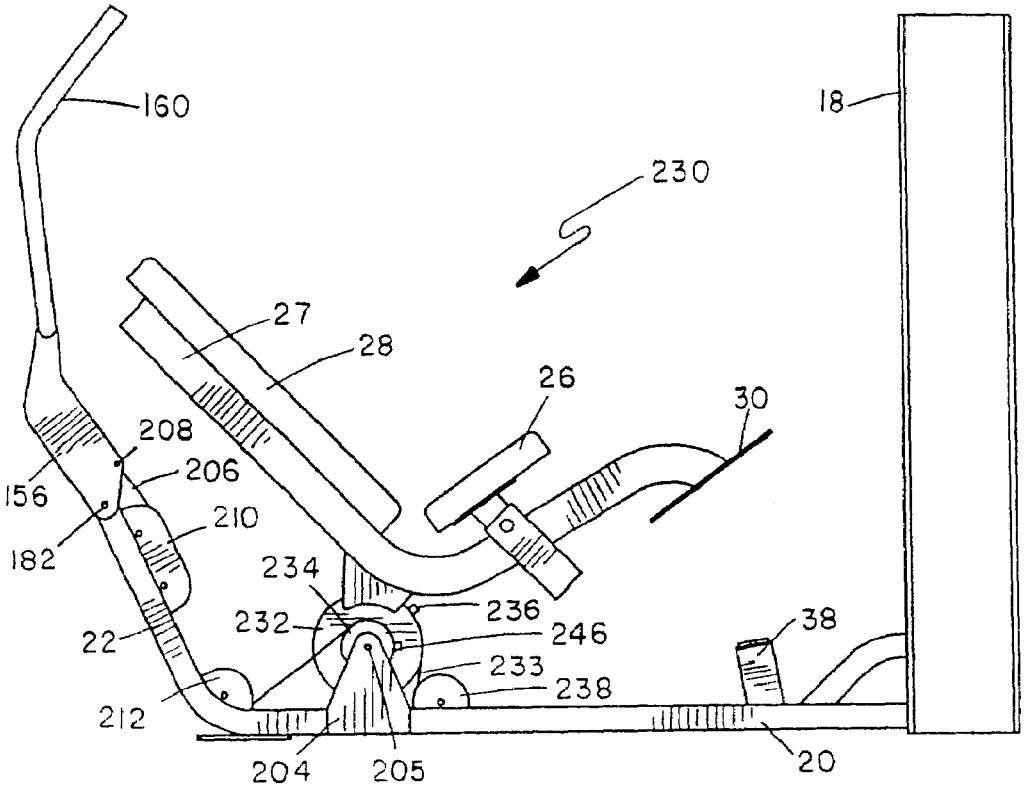
FIG. 33 is a side elevation view of a shoulder press exercise machine according to another embodiment, illustrating the exercise end position.
Figure 34:
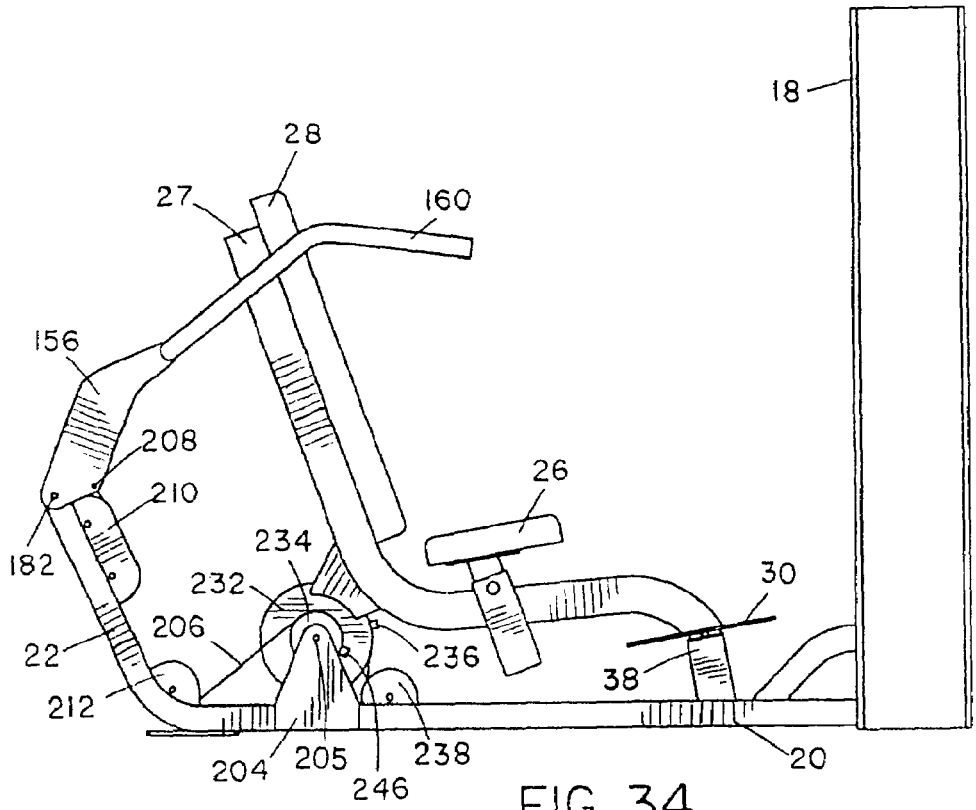
FIG. 34 is a side elevation view of the machine of FIG. 31, illustrating the exercise start position.
Figure 35:
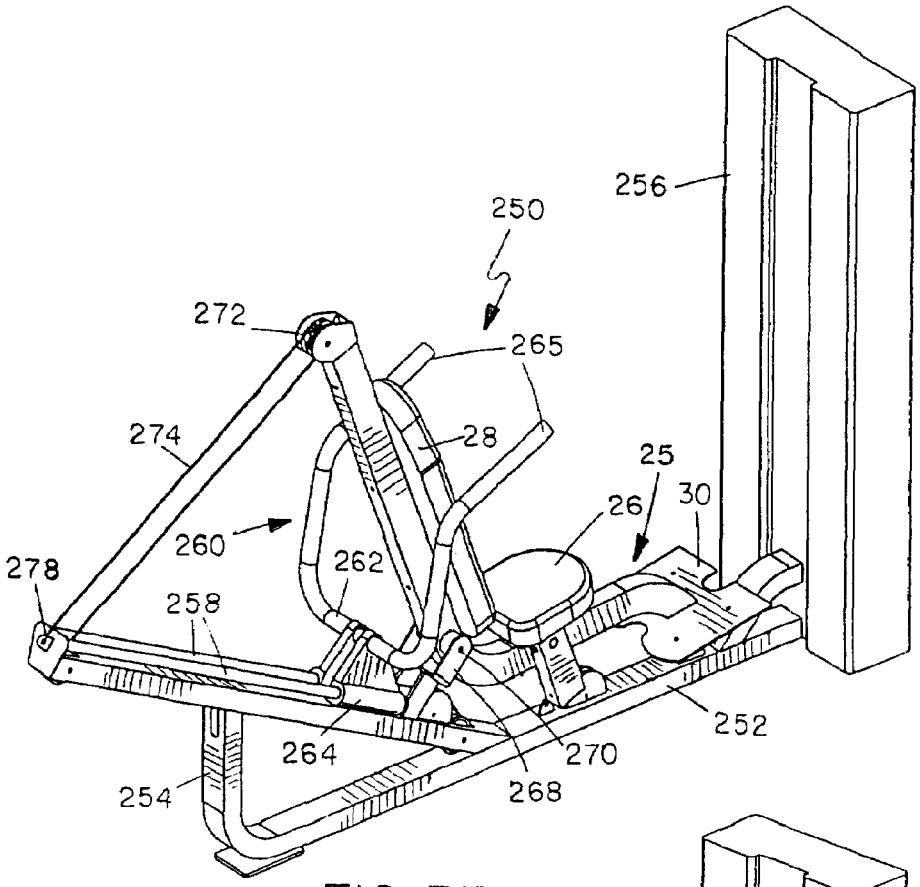
FIG. 35 is a rear perspective view of a shoulder press exercise machine according to another embodiment, illustrating the exercise start position.

FIGS. 33 and 34 illustrate a modified shoulder press exercise machine 230 similar to the machine of FIGS. 27 and 28 but with a different linkage to the exercise resistance. Other parts of this machine are identical to the embodiment of FIGS. 27 and 28, and like reference numerals have been used as appropriate. In this embodiment, the single round cam 202 of FIGS. 27 and 28 is replaced by a double cam, comprising a first, larger user support cam 232 and a smaller cam 234 which is linked to the exercise arm. At least the first, user support cam is mounted on rotating pivot shaft 205, while the second, smaller cam may be attached to the user support cam 232, or may be fixedly attached to the same pivot shaft 205 as the user support cam, so that the cams 232,234 rotate in unison.

The user support 14 is fixedly attached to the user support cam 232, and the cam 232 in turn is linked to the weight stack in housing 18 via a cable 233 extending from anchor 236 on the cam 232, and around a pulley 238 on the base 20 of the main frame, before extending into the weight stack housing and linking to the weight stack in a conventional manner. The exercise arm 155 is linked to the second, smaller cam 234 via a cable 206 extending from an anchor point 208 on the brackets 156, around a double pulley device 210 on the rear upright strut 22, around a further pulley 212 mounted at the junction between the rear strut 22 and base 20 of the main frame, and then connecting to an anchor 246 on the smaller cam 234.

The start and finish positions of the machine 230 are illustrated in FIGS. 34 and 33, respectively, and it can be seen that the exercise arm and user support correspond in orientation and relative positions to the start and finish positions of all of the previous embodiments. The user seated on user support 14 in the start position of FIG. 34 pushes up on handles 160, rotating the exercise arm 155 upwardly and rearwardly about pivot 182. This pulls on cable 206, rotating the smaller cam 234 in a counter-clockwise direction and causing a similar rotation of the larger cam 232, such that the user support 14 is rotated about the pivot axis of pivot shaft 205 into the more rearwardly reclined, end position of FIG. 33. Rotation of cam 232 in turn pulls the resistive cable 233, lifting the selected weights in the weight stack.

FIGS. 35 to 38 illustrate a shoulder press exercise machine 250 according to another embodiment, in which the rotatably mounted exercise arm of the previous embodiments is replaced with a linear movement exercise arm. Machine 250 has a main frame with a base 252, a vertical rear strut 254, an inclined strut 255 extending rearwardly from the base 252 across the upper end of rear strut 254, and a weight stack housing 256 at the forward end of the frame. A pair of guide bars 258 are mounted on the upper side of the inclined strut 255, and an exercise arm 260 comprising a U-shaped member has a central portion 262 secured to linear bearings 264 which are slidably mounted on guide bars 258. The linear bearings 264 may be replaced with wheels, bushings, or any other linear movement device known in the art. Exercise arm 260 has handles 265 at its ends which are bent at an appropriate angle for gripping by a user 266 as illustrated in the start position of FIG. 37.

Figure 36:
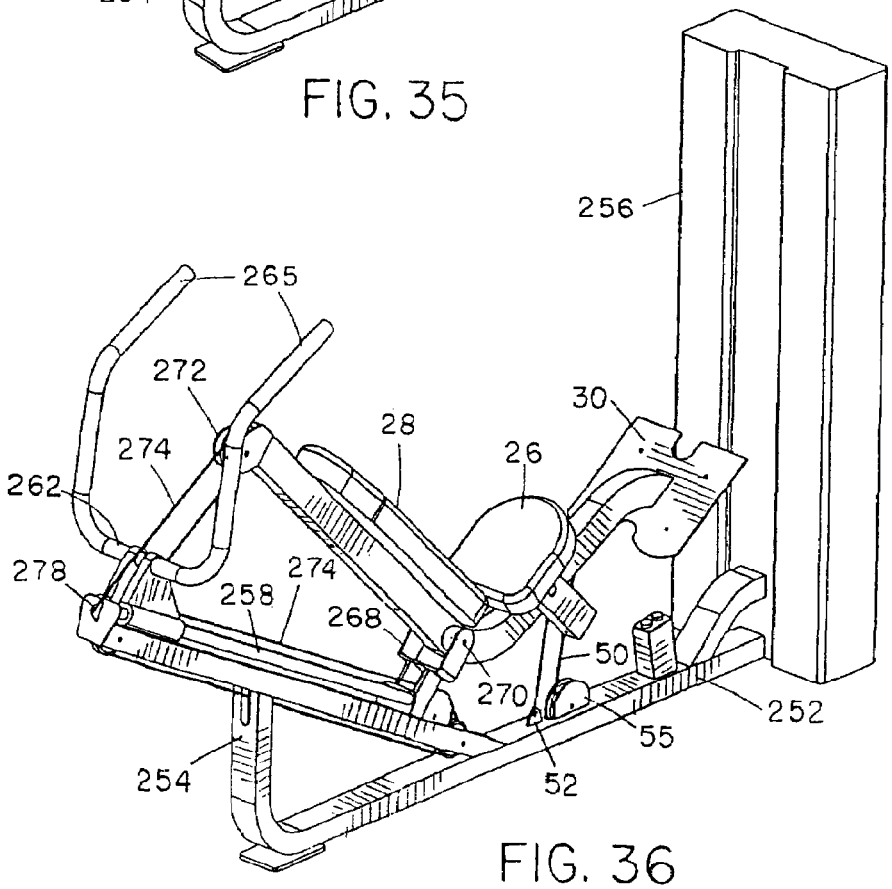
FIG. 36 is a rear perspective view of the machine of FIG. 35, illustrating the exercise end position.
Figure 37:
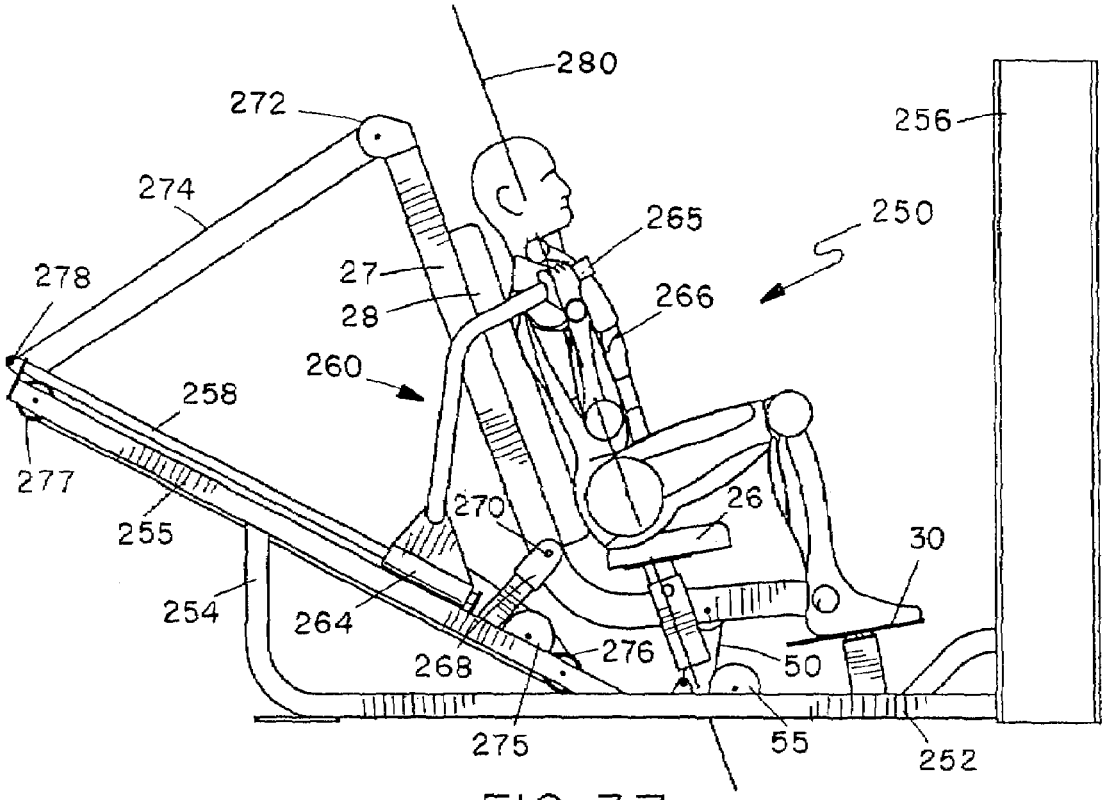
FIG. 37 is a side elevation view of the machine of FIG. 35 in the start position with a user seated on the user support.
Figure 38:
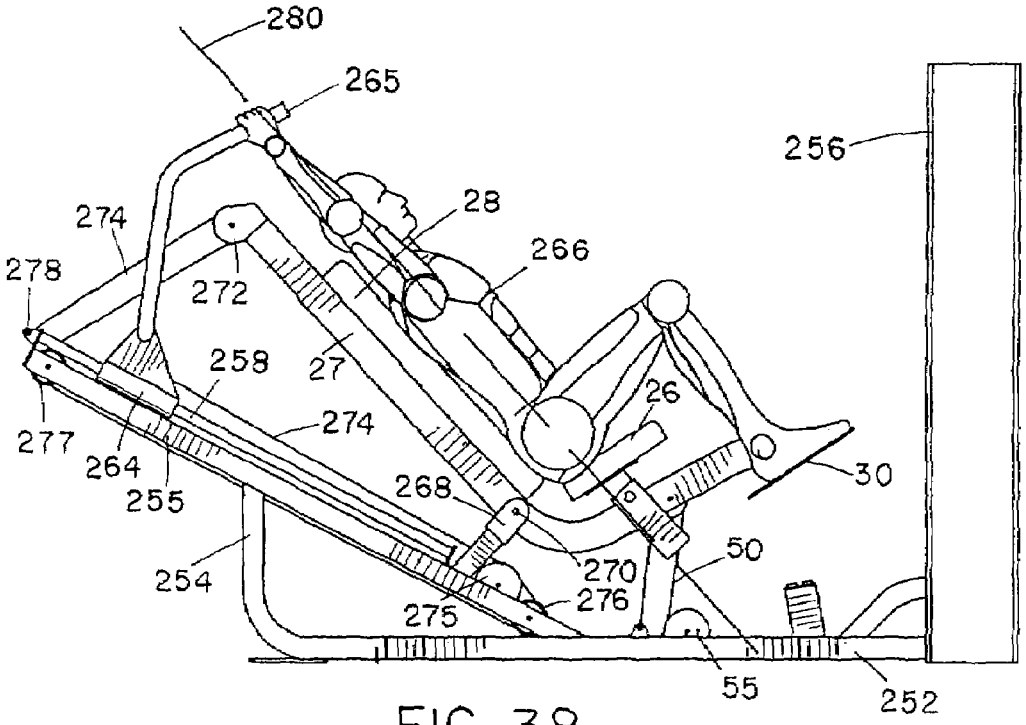
FIG. 38 is a side elevation view similar to FIG. 37, illustrating the exercise end position of the user, user support and exercise arm.

Machine 250 has a user support 14 substantially identical to the previous embodiments, and like reference numerals have been used as appropriate. User support 14 is generally L-shaped with a base 25 on which a seat pad 26 is adjustably mounted, and an upright 27 on which back pad 28 is mounted. A pivot bracket 268 is mounted on the inclined frame strut 255 adjacent the lower ends of guide bars 258, and the user support is pivotally mounted on pivot bracket 268 via pivot pin 270. The base 25 of the user support is linked to the weight stack via a cable and pulley system identical to that of FIGS. 1 to 6, as best illustrated in FIGS. 36 to 38. A pulley 272 is mounted at the upper end of the user support upright 27. A cable 274 has a first end connected to the sliding linear bearings 264 of the exercise arm, and is reeved around a series of pulleys 275,276,277 mounted on the inclined strut 255 of the main frame, then around pulley 272 on the user support, before being connected at its second end to an anchor 278 at the upper end of the inclined strut 255.

FIG. 37 illustrates the user 266 in a start position seated on the user support seat pad 26 (which can be adjusted to the appropriate height) and leaning against back pad 28, with their hands gripping the exercise arm handles 265 at a position corresponding to the start position for a free weight shoulder press exercise. The dotted line 280 represents the side centerline of the user. The user's hands are positioned slightly in front of the shoulder in the starting position. As the exercise arm 260 is pushed upward by the user, the linear bearings 264 slide upwardly and rearwardly along tracks or guide bars 258, pulling cable 274, which in turn pulls on pulley 272 at the upper end of the user support, pulling the user support 14 rearward to rotate about its pivot connection 270 into the end position of FIG. 38.

In the end position of FIG. 38, the user's hands are positioned above their head and in line with the side centerline 280 of the user's body. This machine therefore provides the same self-aligning movement and proper positioning of the user support and user with a linear movement exercise arm as it does with a rotational movement exercise arm.

Although in this embodiment the resistance is supplied by a weight stack which is linked to the user support via a cable and pulley system, it may alternatively be in the form of hand-loaded weight plates mounted on receiving pegs, as in the embodiment of FIGS. 7 and 8. Other variations could have different types of exercise resistance, and exercise resistance connected directly or indirectly to the exercise arm 260.

Figure 39:
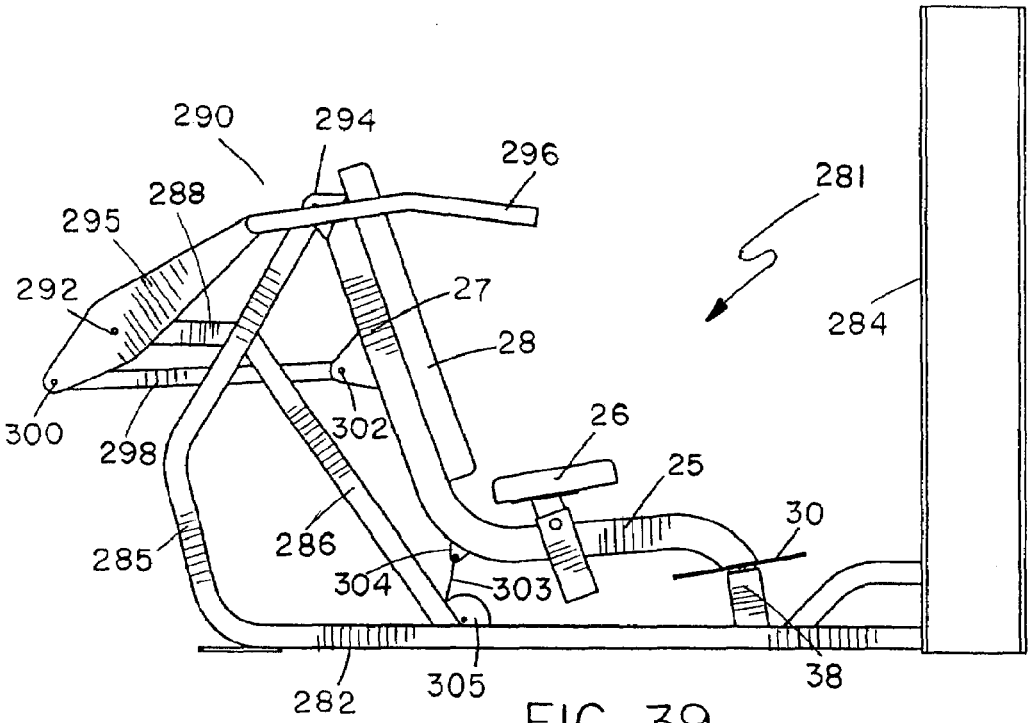
FIG. 39 is a side elevation view of a shoulder press exercise machine according to another embodiment, illustrating the exercise start position.
Figure 40:
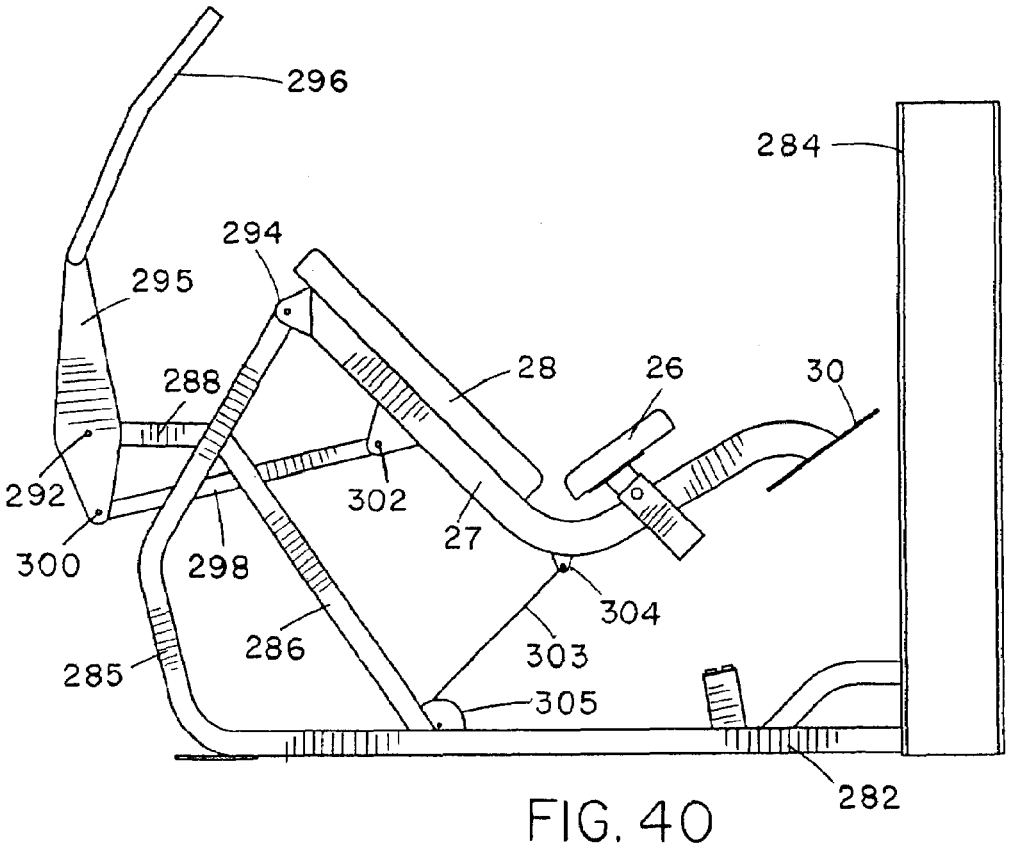
FIG. 40 is a side elevation view of the machine of FIG. 39, illustrating the exercise end position.

FIGS. 39 and 40 illustrate a shoulder press exercise machine 281 according to another embodiment, in which the user support pivot mount and exercise arm pivot mount are modified to change the movement of the user support, such that it travels in a partially forward direction while pivoting into a more rearwardly reclined orientation. The user support 14 of machine 280 is similar to that of the previous embodiments, and like reference numerals have been used as appropriate. The main frame has a base 282 with a weight stack housing 284 at its forward end, as in the first embodiment, but the rear end of the frame is modified. The frame has a rear strut 285 which has a first portion which is substantially vertical, with a very slight rearward inclination, and a forwardly angled upper portion. A second upright strut 286 is inclined rearwardly from a location spaced in front of the rear strut 285, and has a bent rearwardly extending upper portion 288. An exercise arm 290 is pivotally mounted on the rear end of strut upper portion 288 for rotation about pivot 292. User support 14 is pivotally connected to the upper end of the rear strut 285 at the upper end of upright or backrest section 27, via pivot 294.

The exercise arm 290 has a pair of rear or lower pivot brackets 295 and a U-shaped member having a central portion secured to the upper ends of pivot brackets 295 in a similar manner to the embodiment of FIGS. 12 and 13. Forwardly extending handle portions of the U-shaped member extend on opposite sides of the user support 14 in the start position of FIG. 39, and have handles or hand grips 296 at their forward ends. The exercise arm pivot 292 is located in a central region of the exercise arm pivot brackets 295. A connecting link 298 is pivotally connected at one end to the lower ends of the exercise arm pivot brackets 295 via pivot 300, and is pivotally connected at its opposite end to the user support backrest or upright 27 at a location spaced below the user support pivot 294, via pivot 302. The user support 14 is linked to the weight stack in housing 284 via a cable and pulley assembly, comprising cable 303 having one end connected to cable anchor 304 on the underside of the user support at the junction or bend between the upright 27 and base 25, and reeved around a pulley 305 on the frame base 282 before extending through the base and into the housing 284, where it is linked to the weight stack.

In this machine, the start position of FIG. 39 puts the user support 14 and the hand grips 296 of the exercise arms in the same relative orientations and positions as in the previous embodiments. When a user seated on the user support pushes the exercise arm upward, so that it rotates rearwardly about pivot 292, the lower end of the exercise arm pivot bracket is rotated forwardly, pushing the connecting link 298 forward so that it pivots in an anti-clockwise direction about its pivot connection 294 to the main frame. This movement raises the seat pad 26 upward and tilts the back pad 28 rearward, effectively duplicating the exercise arm and user support positioning of the previous embodiments. This movement also pulls on the resistive cable 303, lifting the selected weights in the weight stack. The exercise resistance may alternatively be supplied by plates loaded on receiving pegs mounted to the user support as in FIGS. 7 and 8, or the resistance could be attached to the exercise arm 290 as in the embodiment of FIGS. 29 and 30 or that of FIGS. 31 and 32.

This embodiment has all of the advantages of the self-aligning movement of the previous embodiments, allowing the user to start the exercise in a position which duplicates the start position of a free weight shoulder press and to move from that position to a finish position with their arms directly overhead and their hands aligned with the side centerline of their body, with the user's back being supported throughout the movement and not involved in the exercise. However, this embodiment does not have a user support pivot located beneath the user's body, unlike the previous embodiments, and thus does not have portions of the combined weight of the user and user support on both sides of the gravitational centerline of the pivot. Although there is some starting resistance due to the weight of the user and user support, the combined weight remains forward of the gravitational centerline throughout the exercise, so that there is no appreciable resistance drop off.

FIGS. 41 to 44 illustrate a shoulder press exercise machine 310 according to another embodiment, which has a similar user support pivot mount position to the previous embodiment. The main frame 12 user support 14 in this case are similar or identical to the previous embodiments, and like reference numerals have been used as appropriate. This machine also has an exercise arm 290 identical to that of the previous embodiment, although mounted slightly differently on the main frame. In this embodiment, the exercise arm pivot brackets 295 are pivotally mounted on the upper end of the frame rear upright 22 via pivot 312 which is spaced from the lower ends of the brackets.

A multiple arm linkage system 314 pivotally links the lower ends of the exercise arm brackets 295 to the user support and to the main frame. The linkage system 314 includes a first connecting link 315 having one end pivotally connected to the upper end of the user support upright 27 at pivot 316, and a second, smaller connecting link 318 which is generally L-shaped and has one end pivoted via pivot 319 to a pivot bracket 320 mounted on the user support upright 27 at a location spaced below pivot 316. A third link 322 is pivotally connected to the lower end of the exercise arm brackets at pivot 324, and has a second end pivoted to the end of the second connecting link 318 at pivot 325. Both the first and second links are also pivotally connected to the main frame via pivot brackets 326 mounted on the rear upright 22. The second end of the first connecting link 315 is pivoted to brackets 326 via pivot 328, while the second link is pivotally connected to brackets 326 via pivot 330 at the elbow or the intersection of its two legs.

Figure 41:
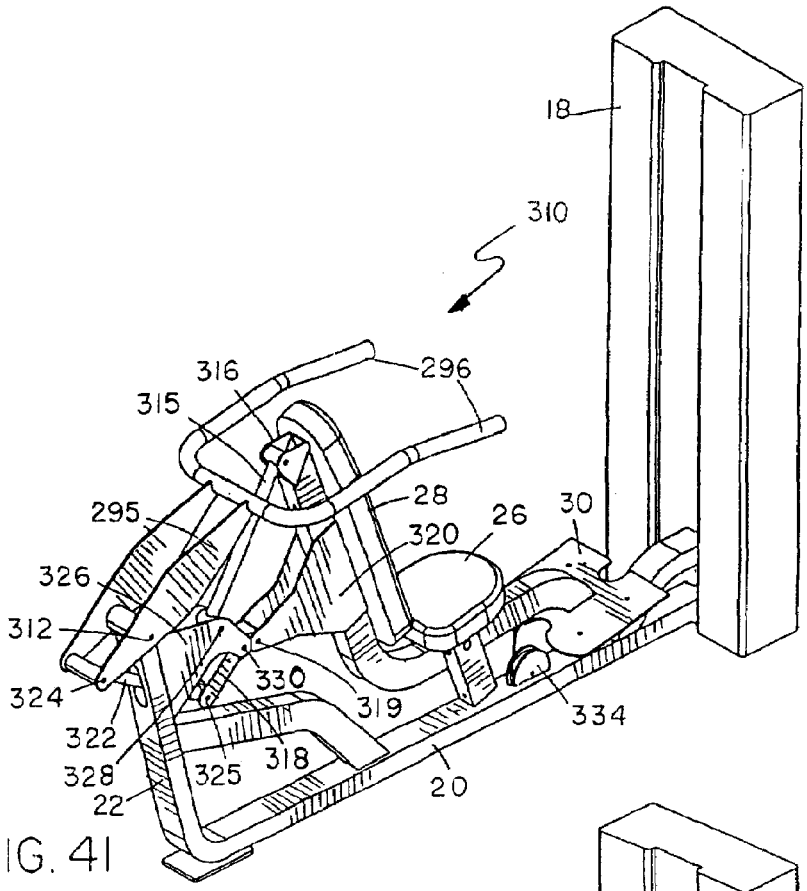
FIG. 41 is a rear perspective view of a shoulder press exercise machine according to another embodiment, illustrating the exercise start position.
Figure 42:
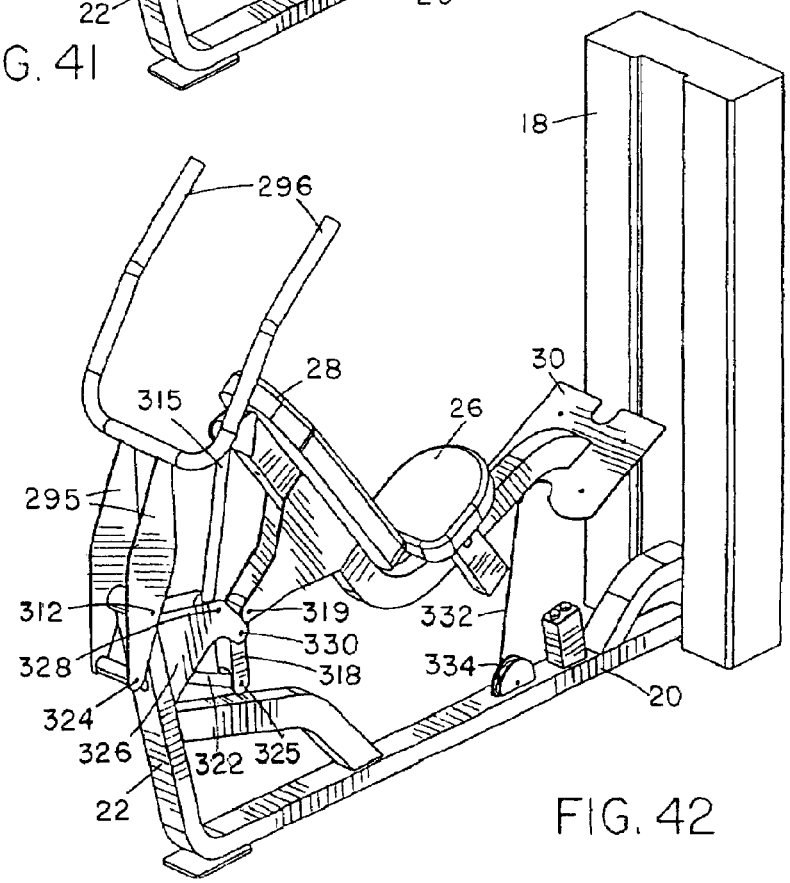
FIG. 42 is a rear perspective view of the machine of FIG. 41, illustrating the exercise end position.
Figure 43:
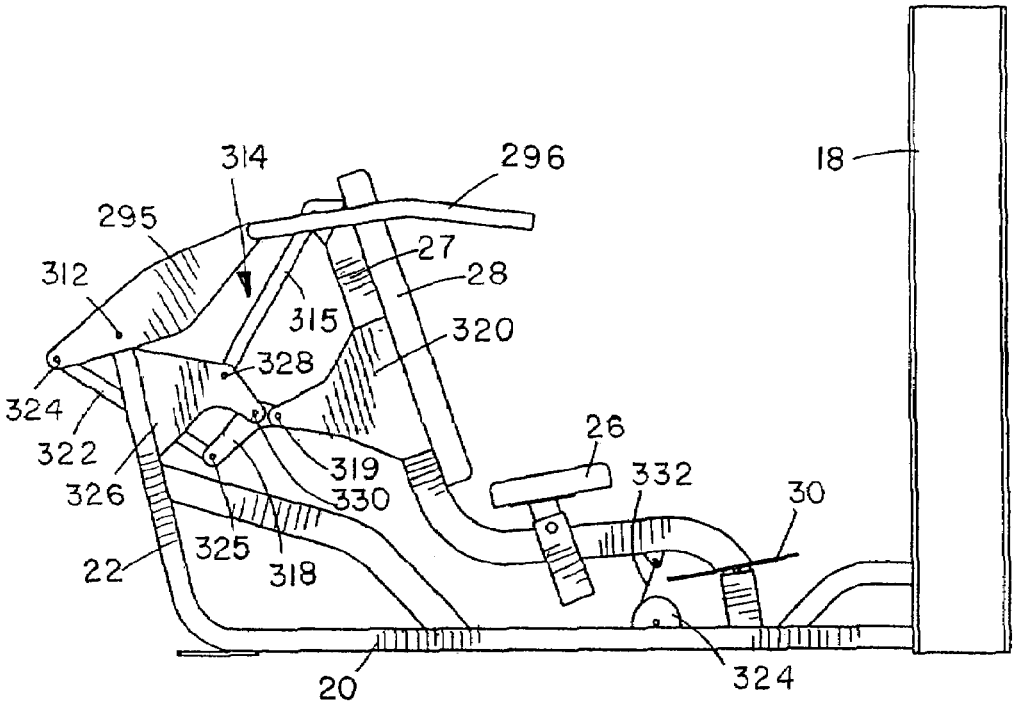
FIG. 43 is a side elevation view of the machine of FIG. 41 in the start position.
Figure 44:
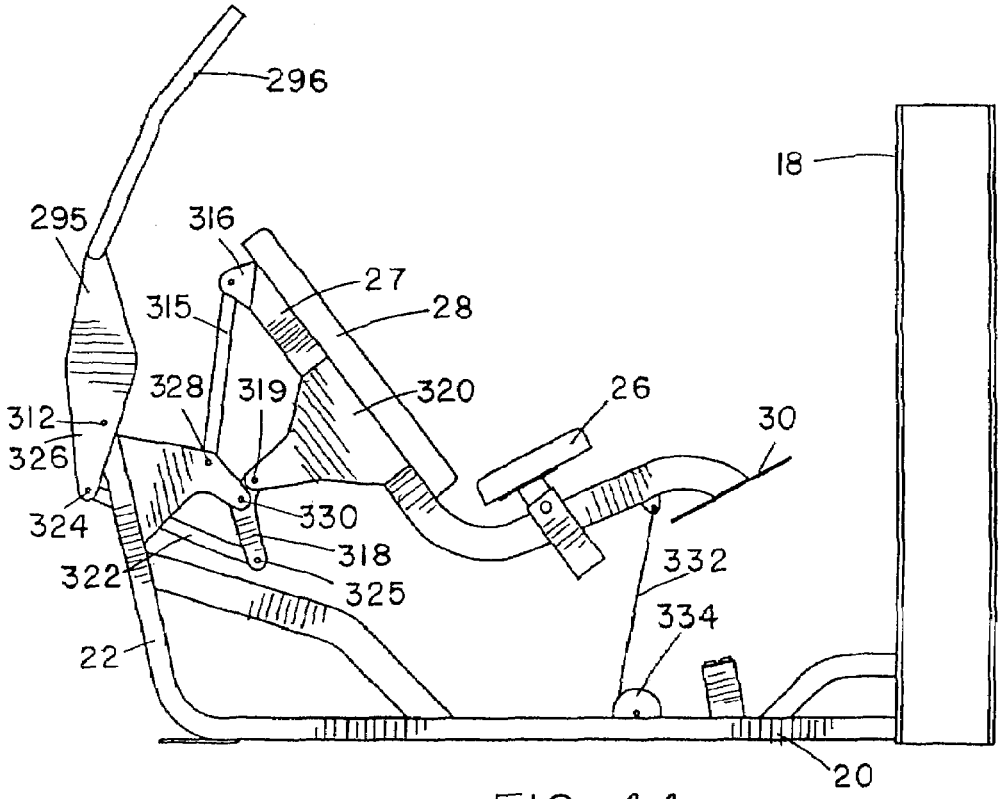
FIG. 44 is a side elevation view similar to FIG. 43, illustrating the exercise end position.

FIGS. 41 and 43 illustrate the start position of the machine, which has the exercise arm and user support in an equivalent position to the previous embodiments. The user grips handles 296 and pushes the front end of exercise arm 290 upwards, rotating the arm 290 about pivot 312 in an anti-clockwise direction. This moves the lower end of the exercise arm brackets 295 forward, pushing the third connecting link 322 forward, which in turn pushes the second link 318, causing it to rotate about its pivot connection 330 to the main frame. Because of the L-shape of the second link 318, this rotation causes the user support 14 to lift upward. At the same time, the first connecting link 315 between the upper end of the user support and the main frame controls movement of the back rest or upright 27 of the user support, causing it to rotate rearward. The end position of the user support is illustrated in FIGS. 42 and 44 and involves upward movement of the user support, along with rearward rotation of the upright 27 into a more reclined position. The user support base 25 is linked to the weight stack via a cable and pulley system similar to the first embodiment, with a cable 332 extending from the underside of base 25, around a pulley 334 on the frame base 22, and into the weight stack housing where it is suitably linked to the weight stack. Again, other types of exercise resistance such as peg mounted weight plates may alternatively be used, and the load may be linked to the exercise arm rather than the user support if desired.

The end position of the user support relative to the user engaging handles 296 of the exercise arm is equivalent to the end positions of the previous embodiments, putting the user in a position in which their arms are extended straight overhead and their hands are in line with the side centerline of their body. As in the embodiment of FIGS. 39 and 40, this machine provides the proper positioning of the user's body in the start and end position, as well as throughout the exercise movement. The combined exercise arm and user support movement provides a self-aligning exercise motion which simulates the upper body motion when performing a free weight shoulder press exercise.

Each of the embodiments of FIGS. 1 to 44 has a pivoting or rocking user support that continuously and automatically self-aligns to the movement of the exercise arm throughout the entire exercise motion, thereby maintaining an ideal alignment relationship between the exerciser positioned on the user support and the user engaging means or handles on the exercise arm. The rocking movement of the user support makes the exercise more fun to perform. Additionally, this design provides the proper starting and finishing alignment between the user and machine for an exercise which simulates a free weight, barbell or dumbbell shoulder press exercise. The combined motion of the user support and exercise arm replicates the natural, small rearward arcing motion an exerciser would go through when performing a free weight shoulder press exercise. This combined motion of the user support and exercise arm also provides a safer and more natural feeling exercise motion, and the user's back is fully supported throughout the exercise so that it is not involved in the exercise. The machines of this invention are an improvement over the exaggerated and unnatural arcing movement of prior art shoulder press exercise machines.

In most of the embodiments described above, apart from those of FIGS. 39 to 44, the user support pivot is positioned behind the hips of the user so that a portion of the user and user support is positioned on both sides of the gravitational center line of the pivot throughout the exercise motion. This limits the effect of the user's body weight on the exercise resistance and provides counter-balancing to prevent or reduce resistance drop-off.

Each of the above shoulder press machines places the user in a start position with their hands gripping the exercise arm handles slightly forward of their shoulders, and an end position with their hands directly overhead and inline with the side centerline of their body. This is essentially the same as the start and finish position of a free weight shoulder press exercise. The user is properly braced with a secondary support or back support during the exercise, and does not have to adjust their body position during the exercise motion, as in some prior art machines. The machines all have user supports which are low to the ground and easily accessible for mounting and dismounting, and do not require the user to climb onto a vertically moving platform or up and down steps in order to reach a user support.

Because the user support aligns to the position of the exercise arm throughout the exercise movement, the handle or user engaging or gripping device can be angularly positioned to reduce strain on the wrist in the starting position, and maintains proper positioning and alignment of the hands and wrists throughout the exercise. The primary and secondary user supports (user support seat and user support back rest) are in fixed alignment to each other and travel together through the same range of motion, and rotate together about a fixed pivot.

It should be understood that the different elements used in the various embodiments described above may be mixed and interchanged. Any of the above linkages between the user support and exercise arm may be used in any of the designs described above. The foot rest could be stationary or move with the user support. The user supports (seat pad, back pad and/or foot rest) may be fixed or adjustable. The exercise arms may be one piece (dependent) or two piece (independent), and may be unidirectional or bidirectional. The connecting links may be adjustable in length, solid links may be replaced with flexible links, and the links may be arranged either to push or pull in order to force rotation of the user support. Different handles may be used without affecting the operation of the machine. The cable and pulley system linked to a weight stack may be replaced with weight plates mounted on pegs. Other types of resistance known in the art, such as hydraulic, pneumatic, or electromagnetic resistance, or elastic bands, may be used in place of the weight stack or weight plates. Cable linkages could be replaced by belts, ropes, chains, or the like, and pulleys may be replaced by sprockets. Any of the various designs could have the resistance associated with any of the moving parts of the machine, i.e. the user support, exercise arm, or connecting link.

In summary, the shoulder press exercise machine of this invention provides an exercise simulating a free weight (barbell or dumbbell) shoulder press exercise which is fun, more comfortable, and safe to use. By forcing the user support to move in a self-aligning motion with the exercise arm, the exaggerated and unnatural arcing movement found in prior art shoulder press machines is avoided, and replaced with a smaller, natural arc similar to that an exerciser would encounter when performing shoulder press exercises with free weights. The reclined seat places the user in a proper starting position and the primary and secondary user supports keep the user in a safe, stable position throughout the exercise. At the same time, the rocking motion of the user support makes the exercise more fun to perform. By adding motion to the user support, performing the exercise is more enjoyable and the user's interest in the workout increases. This may help to convince the user to exercise more regularly.

All of the machines have a user engagement device or exercise arm with a linkage linking movement of the exercise arm to movement of the user support. A load provides resistance to movement of the user support, the exercise arm, and/or the connecting link. Additionally, each design has a primary user support or seat, as well as at least one secondary user support for another part of the user's body. The machines are configured to produce the proper starting and finishing arm/hand positions for the respective shoulder press exercises.

In the above embodiments, the pivoting seat and backrest (user support) continuously and automatically self-aligns to the movement of an exercise arm throughout the entire exercise motion. This combined movement maintains a desirable alignment relationship between the exerciser, positioned on the user support, and the user engaging means (handles) on the exercise arm.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A shoulder press exercise machine, comprising:

a main frame having a user support mount, a forward end and a rear end;

a user support frame movably mounted on the user support mount which is movable between a start position and an end position which is rearwardly displaced relative to the start position during an exercise, the user support frame including a first user support portion and a second user support portion located on the user support frame at a predetermined position relative to the first user support portion such that predetermined, spaced first and second parts of a user's body engage the first and second user support portions only when the user is positioned on the user support frame in an exercise position facing the forward end of the frame, and wherein the second user support portion is adapted to support the upper back of a user;

at least one shoulder press exercise arm movably mounted on one of the frames at a mounting rearward of at least one of the user support portions, the exercise arm having at least one user engagement device adapted for engagement and actuation by a user in performing a shoulder press exercise, the exercise arm being movable in an exercise movement in which the user engagement device is located higher at the end of the exercise movement than at the start of the exercise movement;

the user support frame having no exercise arm movably mounted forward of the first user support portion;

the user engagement device being adapted for engagement by a third part of the user's body different from the parts engaged by the first and second user support portions, the user engagement device and first and second user support portions being located at predetermined spaced positions relative to the main frame in an exercise start position for engagement simultaneously by the first, second and third parts of the user's body when performing a shoulder press exercise facing the forward end of the main frame;

a connecting linkage which connects movement of the exercise arm to movement of the user support frame, whereby exercise movement of the exercise arm simultaneously moves the user support frame in the same general direction as the exercise arm is moved; and a load separate from the user which resists movement of at least one of the user support frame, exercise arm, and connecting linkage;

whereby the combined motion of the user, user support frame and user engagement device substantially replicates the natural movement of the upper part of a human body when performing a free weight shoulder press exercise.

2. The machine as claimed in claim 1, including a foot rest mounted on the main frame in front of the user support frame for supporting the usa's feet during an exercise movement.

3. The machine as claimed in claim 1, wherein the exercise arm is moveably mounted on one of the frames for rotation about an exercise aim pivot.

4. The machine as claimed in claim 1, wherein the exercise arm is moveably mounted on one of the frames for movement in a linear path.

5. The machine as claimed in claim 1, wherein a pair of independently movable exercise anus are movably mounted on one of the frames, each exercise arm having a user engagement device for engagement by a respective one of the user's hands.

6. The machine as claimed in claim 1, wherein the connecting linkage is a rigid link.

7. The machine as claimed in claim 6, wherein the connecting linkage has a first end connected to said exercise arm and a second end connected to said user support frame.

8. The machine as claimed in claim 6, wherein the connecting linkage is adjustable in length.

9. The machine as claimed in claim 1, including a movable member movably mounted on said user support frame, the connecting linkage having a first end connected to said movable member and a second end connected to said exercise arm.

10. The machine as claimed in claim 1, wherein the connecting linkage is flexible.

11. The machine as claimed in claim 1, wherein the connecting linkage comprises a movable member movably mounted on said main frame, a first linkage connecting said movable member to said user support frame, and a second linkage connecting said movable member to said exercise arm.

12. The machine as claimed in claim 1, wherein the connecting linkage comprises a multiple bar linkage between said user support frame, exercise arm, and main frame.

13. The machine as claimed in claim 1, wherein the load comprises weight plates.

14. The machine as claimed in claim 1, wherein said user support frame is L-shaped, having a seat supporting base and an upright, upper body support member and a junction between the base and upper body support member, the upper body support member being adapted to support a part of a user's upper torso during an exercise.

15. A shoulder press exercise machine, comprising:

a main frame having a user support mount, a forward end and a rear end;

a user support frame movably mounted on the user support mount which is adapted to support a user in an exercise ready position facing the forward end of the main frame and movable between a start position and an end position in which at least part of the user support frame is rearwardly displaced relative to the start position, the user support frame having a first user support portion and a second user support portion which support spaced regions of a user's body, the second support portion being secured at a fixed angular orientation relative to the first support portion throughout an exercise movement, and wherein the second user support portion is adapted to support the upper back of a user;

one or more shoulder press exercise arms movably mounted on one of the frames at a mounting rearward of the user support portions, the exercise arm having at least one user engagement device for engaging by a user in performing a shoulder press exercise, and being located higher at the end of a shoulder press exercise than at the beginning of the exercise;

the user support frame having no exercise arm movably mounted forward of the first user support portion;

a connecting linkage which connects movement of the exercise arm to movement of the user support frame, whereby movement of the exercise arm simultaneously moves the user support frame in the same general direction as the exercise arm is moved;

the user support frame, connecting linkage, and exercise arm being adapted to position the first and second user support portions and user engagement device relative to one another throughout an exercise such that a user can simultaneously engage both the first and second user support portions and the user engagement device throughout the entire exercise; and a load for resisting movement of at least one of the user support frame, exercise arm, and connecting linkage;

whereby the combined motion of the user, user support frame and user engagement device substantially replicates the natural movement of the upper part of a human body when performing a free weight shoulder press exercise.

16. The machine as claimed in claim 15, wherein at least part of the user support frame in the end position is positioned upward from the start position.

17. The machine as claimed in claim 15, wherein the first support portion comprises a seat pad.

18. The machine as claimed in claim 17, wherein the second support portion comprises a back pad.

19. The machine as claimed in claim 18, wherein the user support frame is pivotally mounted on the user support mount for rotation between the start and end positions.

20. The machine as claimed in claim 19, wherein the end position of the user support frame is more rearwardly reclined than the start position.

21. The machine as claimed in claim 17, including a foot rest mounted on the user support frame in front of the first user support portion for supporting a user's feet during an exercise movement.

22. A shoulder press exercise machine, comprising:

a main frame having a user support mount, a forward end and a rear end;

a user support frame movably mounted on the user support mount which is movable between a start position and an end position which is rearwardly displaced relative to the start position, the user support frame having a first user support portion and a second user support portion at predetermined positions on the frame to support predetermined spaced regions of a user's body only when the user is positioned in an exercise ready position facing the forward end of the main frame, the first user support portion adapted to support the majority of a user's weight at least in the start position, and the second support portion being secured at a fixed angular orientation relative to the first support portion throughout an exercise movement;

at least one exercise arm movably mounted on one of the frames, the exercise arm having a user engagement device which is engaged by a user in performing a shoulder press exercise, and which is located higher at the end of a shoulder press exercise than at the beginning of the exercise;

a connecting linkage which translates movement of the user engagement device to movement of the user support frame, whereby movement of the user engagement device simultaneously moves the user support frame;

the user support frame having no movably mounted parts spaced forward from said first user support portion; and a load comprising a selectorized weight stack for resisting movement of at least one of the user support frame, user engagement device, and connecting linkage;

whereby the combined motion of the user, user support frame and user engagement device between the start and end position substantially replicates the natural movement of the upper part of a human body when performing a free weight shoulder press exercise.

23. A shoulder press exercise machine, comprising:

a main frame having a user support mount, a forward end and a rear end portion, the main frame having a base and an upright at the rear end portion of the base;

a user support frame movably mounted on the user support mount which is adapted to support a user in an exercise ready position facing the forward end of the frame and which is movable between a start position and an end position that is rearwardly displaced relative to the start position, the user support frame having a first user support portion and a second user support portion which support spaced regions of a user's body, wherein the second support portion is secured at a fixed angular orientation relative to the first support portion throughout an exercise movement and does not comprises handles, the first user support portion comprising a seat pad which is spaced forward from the second user support portion;

an exercise arm movably mounted on said rear upright and having arm portions projecting forward on opposite sides of said user support frame, the exercise arm having at least one user engagement device adapted for engagement by a user in performing a shoulder press exercise while said spaced regions of the user's body engage the first and second user support portions of the user support frame, the user engagement device comprising the only part of the machine actuated by a user during the exercise movement, the exercise arm having a start position corresponding to the start position of the user support frame and an end position higher than the start position, the end position of the exercise arm corresponding to the end position of the user support frame;

a connecting linkage which connects movement of the exercise arm to movement of the user support frame, whereby movement of the exercise arm from the start to the end position simultaneously moves the user support frame from the start to the end position in the same general direction as the exercise arm is moved; and a load for resisting movement of at least one of the user support frame, exercise arm, and connecting linkage;

whereby the combined motion of the user, user support frame and user engagement device between the start and end position substantially replicates the natural movement of the upper part of a human body when performing a free weight shoulder press exercise.

24. A shoulder press exercise machine for performing exercises equivalent to a free weight shoulder press exercise, comprising:

a main frame having a forward end and a rear end;

a user support mount on the main frame;

a user support frame movably mounted on the user support mount which is adapted to support a user in art exercise ready position facing the forward end of the frame and which is movable between a start position and an end position which is rearwardly displaced relative to the start position, the user support frame comprising one moving part of the machine, and having a first support portion and a second support portion which are located at predetermined positions on the user support frame to support spaced locations on a user's body throughout an exercise, the second support portion being secured at a fixed angular orientation relative to the first support portion, the first support portion supporting the majority of a user's weight in the start position of the support frame, and the second support portion remaining in the same fixed angular orientation relative to the first support portion throughout an exercise movement, whereby the first and second support portions travel together at the same angular orientation relative to one another throughout the exercise movement, and wherein the second user support portion is adapted to support the upper back of a user;

at least one exercise arm movably mounted on one of the frames at a mounting rearward of at least the first support portion of the user support frame for engagement by the user in performing exercises, the exercise arm having at least one handle which is adapted for gripping by at least one hand of a user while moving the exercise arm in a predetermined exercise path, the exercise arm comprising a second moving part of the machine;

the user support frame having no exercise arm movably mounted forward of the first support portion of the user support frame;

a connecting link movably engaged with at least two of the main frame, user support frame and exercise arm for linking movement of the exercise arm to movement of the user support frame in the same general direction as the exercise arm is moved, the connecting link comprising a third moving part of the machine; and a load for resisting movement of at least one of the moving parts of the machine;

whereby the combined motion of the user, user support frame and exercise arm between an exercise start and end position substantially replicates the natural movement of the upper part of a human body when performing a free weight shoulder press exercise.

25. The machine as claimed in claim 24, wherein the second support portion comprises an upper torso support and the exercise arm and user support frame are positioned relative to one another in the end position such tat the handle is located above the second support portion of the user support frame, whereby the user's arms are extended above their head in the exercise end position.

26. A shoulder press exercise machine, comprising:

a main frame having a user support mount, a first end and a second end;

a user support frame movably mounted on the user support mount which is adapted to support a user in an exercise ready position facing the first end of the main frame and movable during an exercise between a start position and an end position which is displaced away from the first end of the frame relative to the start position, the user support frame including a first user support portion and a second user support portion, the second support portion being secured at a fixed angular orientation relative to the first support portion, the first support portion adapted to support the majority of a users weight in the start position of the support frame, and the second support portion remaining in the same fixed angular orientation relative to the first support portion throughout an exercise movement, the first and second support portions being located at predetermined positions on the user support frame to support predetermined spaced portions of a user's body only when the user faces the first end of the main frame;

at least one exercise arm movably mounted on one of the frames at a mounting closer to the second end of the frame than at least one of the user support portions, the exercise arm having at least one user engagement device which is adapted to be engaged by a user in performing a shoulder press exercise, the exercise arm being movable in an exercise movement in which the user engagement device is located higher at the end of the exercise movement than at the start of the exercise movement;

a connecting linkage which translates movement of the user engagement device to movement of the user support frame, whereby movement of the user engagement device simultaneously moves the user support frame in the same general direction as the user engagement device is moved; and a load separate from the user which resists movement of at least one of the user support frame, user engagement device, and connecting linkage;

whereby the combined motion of the user, user support frame and user engagement device substantially replicates the natural movement of the upper part of a human body when performing a free weight shoulder press exercise.

* * * * *